US009301604B2

(12) United States Patent
Misener et al.

(10) Patent No.: US 9,301,604 B2
(45) Date of Patent: Apr. 5, 2016

(54) SHELF EXTENDER

(71) Applicant: Process4, Inc., Chagrin Falls, OH (US)

(72) Inventors: Aaron Misener, Chagrin Falls, OH (US); Curtis Taylor, Chagrin Falls, OH (US)

(73) Assignee: Nestec S.A., Vevey (CH)

( * ) Notice: Subject to any disclaimer, the term of this patent is extended or adjusted under 35 U.S.C. 154(b) by 0 days.

(21) Appl. No.: 14/321,912

(22) Filed: Jul. 2, 2014

(65) Prior Publication Data

US 2015/0008203 A1 Jan. 8, 2015

Related U.S. Application Data

(60) Provisional application No. 61/843,587, filed on Jul. 8, 2013.

(51) Int. Cl.

| | |
|---|---|
| ***A47F 5/00*** | (2006.01) |
| ***A47B 45/00*** | (2006.01) |
| ***A47B 96/02*** | (2006.01) |
| *A47F 5/10* | (2006.01) |

(52) U.S. Cl.

CPC ..... *A47B 45/00* (2013.01); *A47B 96/025* (2013.01); *A47F 5/0068* (2013.01); *A47F 5/103* (2013.01)

(58) Field of Classification Search

CPC ..... A47B 45/00; A47B 96/028; A47B 96/02; A47B 96/021; A47B 96/025; A47B 96/027; A47B 57/00; A47B 47/00; A47B 47/02; A47B 47/021; A47B 47/022; A47B 96/06; A47B 96/061; A47F 5/0068; A47F 5/103; A47F 5/0043; A47F 5/0081; A47F 5/10; A47F 5/00

USPC ..... 108/106–108, 90, 65; 248/235, 250; 211/134, 193, 90.01, 87.01

See application file for complete search history.

(56) References Cited

U.S. PATENT DOCUMENTS

| | | | | |
|---|---|---|---|---|
| 3,462,106 | A * | 8/1969 | Buyken | A47B 96/061 248/205.1 |
| 3,647,078 | A * | 3/1972 | Fortunato | 211/134 |
| 4,606,280 | A * | 8/1986 | Poulton et al. | 108/97 |
| 4,853,999 | A * | 8/1989 | Smith | B65G 69/30 14/69.5 |
| 5,170,976 | A * | 12/1992 | Lundman | 248/300 |
| 5,678,699 | A * | 10/1997 | Gebka | A47F 5/0884 211/113 |
| 5,715,622 | A * | 2/1998 | Giordano, Jr. | G09F 3/208 40/448 |

(Continued)

OTHER PUBLICATIONS

Madix, Inc., Informational Document/Specification entitled "Maxi Line Core Components" (2014).

*Primary Examiner* — Joshua Rodden
*Assistant Examiner* — Hiwot Tefera
(74) *Attorney, Agent, or Firm* — Ronald A. Burchett; Julie M. Lappin; Aaron J. Morrow

(57) ABSTRACT

A shelf extender that is designed to be connected to a shelf of an existing shelf system to increase a total depth of a shelf of the shelf system. The shelf extender includes a body portion and a connection arrangement. The shelf extender can include one or more legs and/or support flanges. The body portion has a generally flat and planar top surface. The top surface generally has a depth that is less than a depth of a top surface of the shelf. The connection arrangement generally lies in the same plane as the top surface of the body portion. The connection arrangement is connected to the body portion and includes a connector designed secure the connection arrangement to a top surface of the existing shelf.

18 Claims, 22 Drawing Sheets

(56) References Cited

U.S. PATENT DOCUMENTS

| | | | | |
|---|---|---|---|---|
| 5,924,367 | A * | 7/1999 | Henke et al. | 108/108 |
| 5,992,072 | A * | 11/1999 | Garfinkle | 40/642.02 |
| 6,119,990 | A * | 9/2000 | Kump et al. | 248/220.22 |
| 6,276,810 | B1 * | 8/2001 | Vosshenrich | 362/127 |
| 6,318,684 | B1 * | 11/2001 | Ireland | A47F 5/0068 108/77 |
| 6,688,567 | B2 * | 2/2004 | Fast et al. | 248/220.41 |
| 6,907,829 | B2 * | 6/2005 | Bambach et al. | 108/65 |
| 7,455,081 | B2 * | 11/2008 | Bacnik | 40/661.03 |
| 7,726,057 | B2 * | 6/2010 | Brinkman | G09F 3/204 248/220.21 |
| 7,824,055 | B2 * | 11/2010 | Sherman | 362/125 |
| 8,191,193 | B2 * | 6/2012 | Bailie et al. | 14/69.5 |
| 8,231,016 | B2 * | 7/2012 | Berdahl et al. | 211/119.003 |
| 2004/0050812 | A1 * | 3/2004 | Rojas et al. | 211/134 |
| 2004/0237369 | A1 * | 12/2004 | Andersson | 40/661.03 |
| 2008/0285260 | A1 * | 11/2008 | Sherman | 362/133 |
| 2011/0247530 | A1 * | 10/2011 | Coffman | 108/116 |

* cited by examiner

SHELF EXTENDER

The present invention claims priority on U.S. Provisional Patent Application Ser. No. 61/843,587 filed Jul. 8, 2013, which is incorporated herein.

The present invention relates to a shelf, more particularly to a shelf that includes a shelf extender.

BACKGROUND OF THE INVENTION

Many retail establishments use shelving systems to display various types of products. These shelf systems have a fixed depth shelf that is designed to support a product on the top surface of the shelf. Typically, one or more of the shelves can be height adjusted to accommodate various types of products. Although these prior art shelf systems have been widely used and are effective in supporting and displaying products, these shelving systems encounter problems when the products to be stored on a shelf require an increased shelf depth. Prior art shelf systems are only height adjustable to enable an adjustment of the height between the shelves. The depth of the shelves is fixed. As such, products that have a depth dimension that is greater than the depth of the shelf will overhand the front end of the shelf. In many situations, such an overhang can be unsightly and result in a cart or consumer bumping onto the overhanging goods as a cart or shopper moves through an aisle of shelves.

In view of the deficiencies of prior art shelving systems, there is a need for a shelf system that can be adjustable so that the depth of one or more of the shelves of the shelf system can be adjusted to accommodate various types of goods.

SUMMARY OF THE INVENTION

The present invention is directed to an adjustable shelf system, particularly to a shelf system that enables one or more of the shelves to have an adjustable shelf depth, and still more particularly to a shelf system that enables one or more of the shelves to have an adjustable shelf depth and also allow the spacing between two or more shelves to be adjustable.

In one non-limiting aspect of the present invention, there is provided a shelf extender that can be connected to an existing shelf system to extend the depth of the existing shelf. The shelf extender of the present invention is designed to be connected to standard shelves such as, but not limited to, shelving systems offer by Madix, Inc. and Lozier Corporation. For example, the Maxi Line shelf system offered by Madix, Inc. is an example of a popular shelving system that is used in the United States and Canada. The back of the shelf includes one or more brackets that are used to connect into slots or opening in vertical railing or columns. These shelves are generally designed to be self-loading. The front portion of the shelves generally includes a plurality of holes or openings. The front edge of the shelf generally includes a contoured or non-flat surface and optionally includes a bottom lip. The front edge generally slopes outwardly from top to bottom; however, this is not required. Such non-limiting shelves are illustrated in the Madix Maxi Line Core Components catalog of 2014 which is available at www.madixinc.com and which is incorporated herein by reference. The shelf extender of the present invention is designed to be releasably connectable to an existing shelf system; however, this is not required. The shelf extender of the present invention is designed to be connectable to an existing shelf system without having to remove the shelf during attachment and/or detachment of the shelf extender; however, this is not required. The shelf extender of the present invention is designed to be connectable to a base shelf and/or to a shelf located above a base shelf. The shelf extender for connection to a base shelf can be designed the same or differently from a shelf extender that is designed to be connected to a shelf located above a base shelf. The size, configuration and materials used for the shelf extender are non-limiting. For example, the shelf extender can be formed of one or more durable materials (e.g., plastic, metal, wood, paper board, composite materials, glass etc.).

In another and/or alternative non-limiting aspect of the present invention, the shelf extender is designed to be connectable to a base shelf of an existing shelf system. The extension of the base shelf by the shelf extender can be used to support items having a dimension that exceeds the depth of a standard shelf so that the item does not overhang the shelf; however, this is not required. The extension of the base shelf by the shelf extender can also or alternatively be used to enable items to be placed partially or fully outwardly from under a shelf spaced above the base shelf so as to 1) draw additional attention to the item on the base shelf, 2) provide easier access to the item on the base shelf, and/or 3) make it easier to lift and/or remove an item on the base shelf; however, this is not required. The shelf extender can have many configurations for connecting to the base shelf. In one non-limiting embodiment, the shelf extender includes a body portion, a connection arrangement designed to connect to the front portion of an existing shelf, and at least one support leg. The top surface of the body portion is generally flat and planar; however, this is not required. The width of the top surface of the body is generally the same as the width of the shelf to which the shelf extender is to be connected; however, this is not required. In one non-limiting configuration, the width of the top surface the body portion of the shelf extender is about 30% to 150% (e.g., 30%, 30.1%, 30.2% . . . 149.8%, 149.9%, 150%, and all values and ranges therebetween) of the width of the shelf to which the shelf extender is to be connected The depth of the top surface of the body portion of the shelf extender is generally less than the depth of the shelf to which the shelf extender is to be connected; however, this is not required. In one non-limiting configuration, the depth of the top surface of the body portion of the shelf extender is about 10% to 90% (e.g., 10%, 10.1%, 10.2% . . . 89.8%, 89.9%, 90%, and all values and ranges therebetween) of the depth of the shelf to which the shelf extender is to be connected. The connection arrangement of the shelf extender is defined as the portion of the shelf extender that overlaps a top surface of the shelf to which the shelf extender is to be connected when the shelf extender is connected to the shelf. The connection arrangement can be a mere rearward extension of the body portion of the shelf extender and/or some other structure. The connection arrangement can be integrally formed with the top surface of the body portion and/or other structure of the shelf extender or be a component that is connected by a weld, solder, adhesive, bolt, rivet, etc. The connection arrangement generally includes an arrangement that secures and/or facilitates in securing the connection arrangement to the top surface of the shelf to which the shelf extender is to be connected. As can be appreciated, the connection arrangement can be also or alternatively designed to connect to the front face of the shelf and/or to the bottom surface of the shelf; however, this is not required. When the connection arrangement is designed to secure and/or facilitate in securing the connection arrangement to the top surface of the shelf, such an arrangement can include a pin, threaded post, or the like that is insertable into an opening in the top surface of the shelf to which the shelf extender is to be connected. Alternatively or additionally, the arrangement can include a slot or opening that is designed to align with an opening in the top surface of the shelf to which the shelf extender is to be connected so that a pin, bolt, etc. can be inserted through the aligned openings and thereby be used to secure the connection arrangement of the shelf extender to the top surface of the shelf. One or more legs are designed to be connected to the body portion of the shelf extender. The one or more legs can be connected to the body portion by a variety of means (e.g., adhesive, bolt, rivet, screw, nail, slot and groove connection, solder, weld, pin connection, etc.). In one non-limiting arrangement, the leg extends from a bottom surface of the body portion of the shelf extender. In one non-limiting configuration, the top of the leg includes a threaded opening that threadedly receives a screw that is inserted through an opening in the top surface of the body portion. In another non-limiting configuration, the length of the leg is adjustable; however, this is not required. As can be appreciated, a permanently threaded stud can exist on the bottom surface of the body portion such that the leg is threaded onto such stud to connect the legs to the body portion; however, this is not required. The leg can be configured in many different ways so that the length of the leg can be adjustable. In one non-limiting configuration, the base of the leg is threaded to the body of the leg. This threaded arrangement allows the base to be fully screwed into, or be partially screwed out from, the base thereby enabling the length of the leg to be adjusted. The base of the leg is designed to rest upon a floor surface and provide support to the shelf extender. The ability of the leg length to be adjustable can be used to ensure that the leg provide the designed support to the shelf extender when the shelf extender is connected to a base shelf. The shelf extender can optionally include other support structures (e.g., side flange, front flange, rear flange, width flange, depth flange, etc.) to provide strength and/or rigidity to the shelf extender and/or to facilitate in the connection of the shelf extender to an adjacently positioned shelf extender. In one non-limiting arrangement, one or both sides of the shelf extender include a side flange that is used to provide strength and/or rigidity to the shelf extender and/or facilitate in the connection of the shelf extender to an adjacently positioned shelf extender. The one or two side flanges can optionally include a connection arrangement (e.g, opening, slot, threaded post, hook, etc.) that can be used to facilitate in the connection of the shelf extender to an adjacently positioned shelf extender. In another and/or alternative non-limiting arrangement, the rear of the shelf extender includes a rear flange that is used to provide strength and/or rigidity to the shelf extender and/or to facilitate in the connection of the shelf extender to the shelf. The rear flange can optionally include a connection arrangement (e.g, opening, slot, threaded post, hook, etc.) that can be used to facilitate in the connection of the shelf extender to the shelf. In still another and/or alternative non-limiting arrangement, the front of the shelf extender includes a front flange that is used to provide strength and/or rigidity to the shelf extender. The depth of the top surface of the shelf extender can be constant or vary along the longitudinal width of the shelf extender. In one non-limiting arrangement, when the shelf extender is connected to a base shelf that is positioned at the end of a shelf system, the depth of the top surface of the shelf extender can narrow toward the end of the shelf system; however, this is not required. This narrowing or tapering of the depth can be a constant or variable tapering.

In still another and/or alternative non-limiting aspect of the present invention, the shelf extender is designed to be connectable to a shelf of an existing shelf system. The shelf can be a base shelf or a shelf located above the base shelf. The extension of the shelf by the shelf extender can be used to support items having a dimension that exceeds the depth of a standard shelf so that the item does not overhang the shelf; however, this is not required. The extension of the shelf by the shelf extender can also or alternatively be used to enable items to be placed partially or fully outwardly from under a shelf spaced above another shelf so as to 1) draw additional attention to the item on the base shelf, 2) provide easier access to the item on the shelf, and/or 3) make it easier to lift and/or remove an item on the shelf; however, this is not required. The shelf extender can have many configurations for connecting to the shelf. In one non-limiting embodiment, the shelf extender includes a body portion, a connection arrangement designed to connect to the front portion of an existing shelf, and at least one support flange. The top surface of the body portion is generally flat and planar; however, this is not required. The width of the top surface of the body is generally the same as the width of the shelf to which the shelf extender is to be connected; however, this is not required. In one non-limiting configuration, the width of the top surface the body portion of the shelf extender is about 30% to 150% (e.g., 30%, 30.1%, 30.2% . . . 149.8%, 149.9%, 150%, and all values and ranges therebetween) of the width of the shelf to which the shelf extender is to be connected. The depth of the top surface the body portion of the shelf extender is generally less than the depth of the shelf to which the shelf extender is to be connected; however, this is not required. In one non-limiting configuration, the depth of the top surface of the body portion of the shelf extender is about 10% to 90% (e.g., 10%, 10.1%, 10.2% . . . 89.8%, 89.9%, 90%, and all values and ranges therebetween) of the depth of the shelf to which the shelf extender is to be connected. The connection arrangement of the shelf extender is defined as the portion of the shelf extender that overlaps a top surface of the shelf to which the shelf extender is to be connected when the shelf extender is connected to the shelf. The connection arrangement can be a mere rearward extension of the body portion of the shelf extender and/or some other structure. The connection arrangement can be integrally formed with the top surface of the body portion and/or other structure of the shelf extender or be a component that is connected by a weld, solder, adhesive, bolt, rivet, etc. The connection arrangement generally includes an arrangement that secures and/or facilitates in securing the connection arrangement to the top surface of the shelf to which the shelf extender is to be connected. As can be appreciated, the connection arrangement can be also or alternatively designed to connect to the front face of the shelf and/or to the bottom surface of the shelf; however, this is not required. When the connection arrangement is designed to secure and/or facilitate in securing the connection arrangement to the top surface of the shelf, such an arrangement can include a pin, threaded post, or the like that is insertable into an opening in the top surface of the shelf to which the shelf extender is to be connected. Alternatively or additionally, the arrangement can include a slot or opening that is designed to align with an opening in the top surface of the shelf to which the shelf extender is to be connected so that a pin, bolt, etc. can be inserted through the aligned opening and thereby be used to secure the connection arrangement of the shelf extender to the top surface of the shelf. One or more support flanges are connected to a bottom surface of the body portion. The one or more support flanges can be connected to the body portion by a variety of means (e.g., adhesive, bolt, rivet, screw, nail, slot and groove connection, solder, weld, pin connection, etc.). In one non-limiting configuration, a pin, threaded post, etc. extends from the bottom surface of the body portion and is received in a slot or opening in the support flange. A nut, pin, clamp, etc., can then be secured to the pin, threaded post, etc.

to thereby secure the support flange to the bottom surface of the body of the shelf extender. In another non-limiting configuration, the top surface of the body portion includes a slot or opening that is designed to receive a pin, threaded post, screw, etc., that can extend through the top surface and be received in a slot or opening in the support flange. A nut, pin, clamp, etc., can then be secured to the screw, pin, threaded post, etc., to thereby secure the support flange to the bottom surface of the body of the shelf extender. When a slot is included in the top surface of the body portion, the slot extends perpendicular to the width or longitudinal length of the body portion of the shelf extender; however, this is not required. The length of the slot is generally less than a depth of the body portion. In one non-limiting configuration, the length of the slot is about 5% to 70% (e.g., 5%, 5.1%, 5.2% . . . 69.8%, 69.9%, 70%, and all values and ranges therebetween) of the depth of the body portion of the shelf extender. The slot enables the support flange to be positionable and adjustable along the width of the body portion so that the back end of the support flange can be adjusted and positioned relative to the front end of the shelf to which the shelf extender is to be connected. The length of the support flange is generally less than a depth of the body portion. In one non-limiting configuration, the length of the support flange is about 10% to 99% (e.g., 10%, 10.1%, 10.2% . . . 98.8%, 98.9%, 99%, and all values and ranges therebetween) of the depth of the body portion of the shelf extender. The front face of the support flange can optionally include a connector that fits into and engages a concave or generally C-shaped front end of the shelf. In many configurations of the front face of a shelf, the lower portion of the front face curves upwardly to form a base trough that enables a rear portion of the support flange to fit into and engage the trough in the front face of the shelf to thereby create a rear support for the support flange when the shelf extender is connected to the shelf. After the rear of the support flange is positioned in the concave or generally C-shaped front end of the shelf, the connection arrangement of the shelf extender is connected to the top surface of the shelf thereby securing the support flange in the concave or generally C-shaped front end of the shelf and securing the body portion of the shelf extender to the shelf. The shelf extender can optionally include other support structures (e.g., side flange, front flange, rear flange, width flange, depth flange, etc.) to provide strength and/or rigidity to the shelf extender and/or to facilitate in the connection of the shelf extender to an adjacently positioned shelf extender. In one non-limiting arrangement, one or both sides of the shelf extender include a side flange that is used to provide strength and/or rigidity to the shelf extender and/or facilitate in the connection of the shelf extender to an adjacently positioned shelf extender. The one or two side flanges can optionally include a connection arrangement (e.g, opening, slot, threaded post, hook, etc.) that can be used to facilitate in the connection of the shelf extender to an adjacently positioned shelf extender. In still another and/or alternative non-limiting arrangement, the front of the shelf extender includes a front flange that is used to provide strength and/or rigidity to the shelf extender. The depth of the top surface of the shelf extender can be constant or vary along the longitudinal width of the shelf extender. In one non-limiting arrangement, when the shelf extender is connected to a shelf that is positioned at the end of a shelf system, the depth of the top surface of the shelf extender can narrow toward the end of the shelf system; however, this is not required. This narrowing or tapering of the depth can be a constant or variable tapering.

In one non-limiting object of the present invention, there is provided a shelf extender that can be used to increase the depth of a shelf of a shelf system.

In another and/or alternative non-limiting object of the present invention, this is provided a shelf extender that can be connected to an existing shelf system.

In still another and/or alternative non-limiting object of the present invention, there is provided a shelf extender designed to be releasably connectable to an existing shelf system.

In yet another and/or alternative non-limiting object of the present invention, there is provided a shelf extender designed to be connectable to an existing shelf system without having to remove the shelf during attachment and/or detachment of the shelf extender.

In still yet another and/or alternative non-limiting object of the present invention, there is provided a shelf extender designed to be connectable to a base shelf and/or to a shelf located above a base shelf.

In another and/or alternative non-limiting object of the present invention, there is provided a shelf extender that can be used to support items having a dimension that exceeds the depth of a standard shelf so that the item does not overhang the shelf.

In still another and/or alternative non-limiting object of the present invention, there is provided a shelf extender that can be used to enable items to be placed partially or fully outwardly from under a shelf spaced above the base shelf so as to 1) draw additional attention to the item on the base shelf, 2) provide easier access to the item on the base shelf, and/or 3) make it easier to lift and/or remove an item on the base shelf.

In yet another and/or alternative non-limiting object of the present invention, there is provided a shelf extender that includes a body portion, a connection arrangement designed to connect to the front portion of an existing shelf, and at least one support leg.

In still yet another and/or alternative non-limiting object of the present invention, there is provided a shelf extender where the top surface of the body portion of the shelf extender is generally flat and planar.

In another and/or alternative non-limiting object of the present invention, there is provided a shelf extender where a width of the top surface the body portion of the shelf extender is about 30% to 150% of the width of the shelf to which the shelf extender is to be connected.

In still another and/or alternative non-limiting object of the present invention, there is provided a shelf extender where a depth of the top surface the body portion of the shelf extender is generally less than the depth of the shelf to which the shelf extender is to be connected.

In yet another and/or alternative non-limiting object of the present invention, there is provided a shelf extender where a depth of the top surface of the body portion of the shelf extender is about 10% to 90% of the depth of the shelf to which the shelf extender is to be connected.

In still yet another and/or alternative non-limiting object of the present invention, there is provided a shelf extender that includes a leg wherein the leg length can be adjustable.

In another and/or alternative non-limiting object of the present invention, there is provided a shelf extender that includes one or more other support structures (e.g., side flange, front flange, rear flange, width flange, depth flange, etc.) to provide strength and/or rigidity to the shelf extender and/or to facilitate in the connection of the shelf extender to an adjacently positioned shelf extender.

In still another and/or alternative non-limiting object of the present invention, there is provided a shelf extender where a depth of the top surface of the shelf extender can be constant or vary along the longitudinal width of the shelf extender.

In yet another and/or alternative non-limiting object of the present invention, there is provided a shelf extender that includes a body portion, a connection arrangement designed to connect to the front portion of an existing shelf, and at least one support flange.

In still yet another and/or alternative non-limiting object of the present invention, there is provided a shelf extender that has one or more support flanges connected to a bottom surface of the body portion.

In another and/or alternative non-limiting object of the present invention, there is provided a shelf extender where a top surface of the body portion of the shelf extender includes a slot or opening that is designed to receive a pin, threaded post, screw, etc. that can extend through the top surface and be received in a slot or opening in the support flange.

In still another and/or alternative non-limiting object of the present invention, there is provided a shelf extender where a top surface of the body portion of the shelf extender includes a slot or opening that is less than a depth of the body portion.

In yet another and/or alternative non-limiting object of the present invention, there is provided a shelf extender where a top surface of the body portion of the shelf extender includes a slot or opening that enables the support flange to be positionable and adjustable along the width of the body portion so that the back end of the support flange can be adjusted and positioned relative to the front end of the shelf to which the shelf extender is to be connected.

In still yet another and/or alternative non-limiting object of the present invention, there is provided a shelf extender that has a support flange wherein the length of the support flange is less than a depth of the body portion.

In another and/or alternative non-limiting object of the present invention, there is provided a shelf extender that has a support flange wherein a front face includes a connector that fits into and engages a concave or generally C-shaped front end of the shelf.

These and other objects, features and advantages of the present invention will become apparent from the subsequent description taken in conjunction with the accompanying drawings.

BRIEF DESCRIPTION OF THE FIGURES

Reference may now be made to the drawings, which illustrate various non-limiting embodiments that the invention may take in physical form and in certain parts and arrangements of parts wherein.

DETAILED DISCUSSION OF NON-LIMITING EMBODIMENTS

Figure 1:
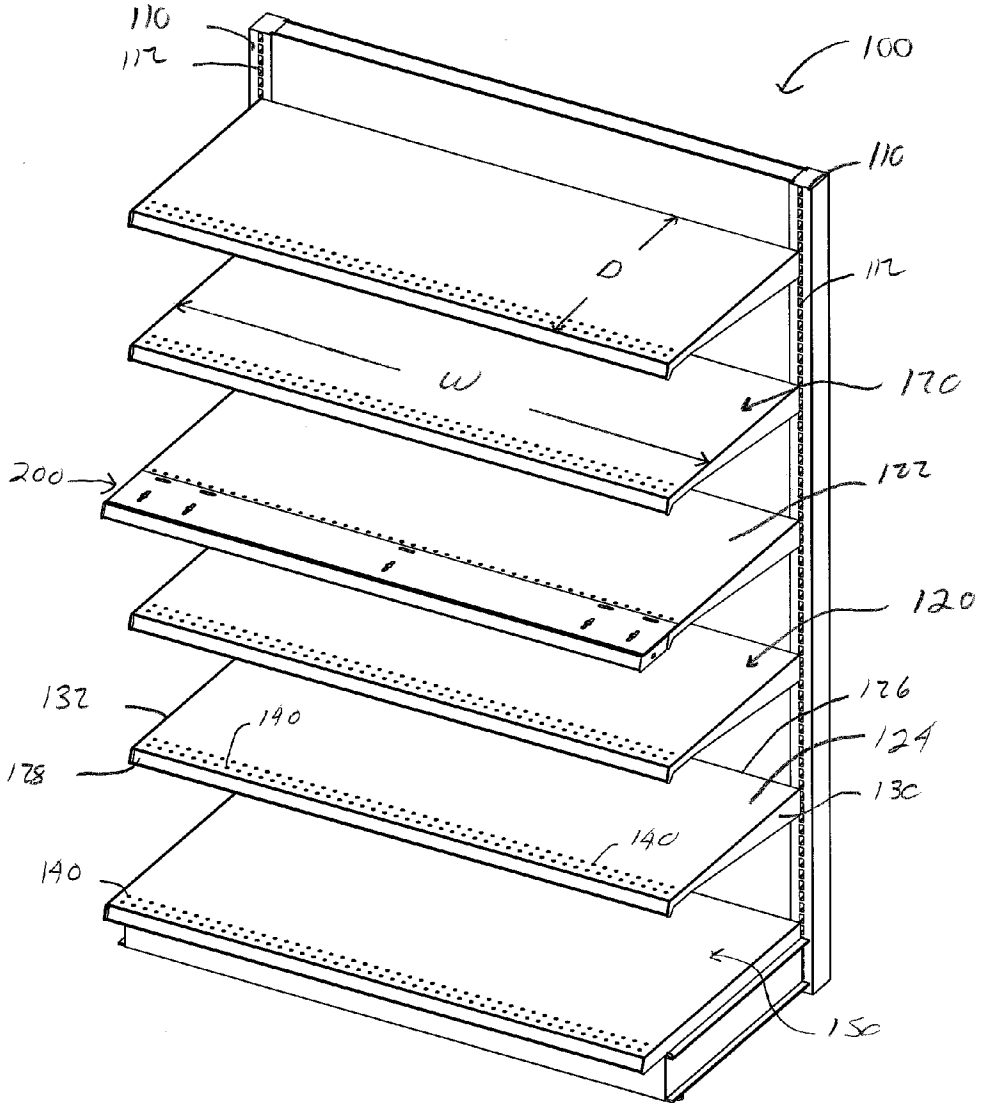
FIG. 1 is a front elevation view of a standard display shelf system wherein one of the shelves includes a shelf extender in accordance with the present invention.

Referring now to the drawings wherein the showing is for the purpose of illustrating non-limiting embodiments of the invention only and not for the purpose of limiting the same, as illustrated in FIGS. 1-22 there are illustrated non-limiting shelf extenders in accordance with the present invention. The shelf extender is designed to connect to an existing shelf on a shelf system and increase the depth of the shelf arrangement. Referring now to FIG. 1, there is illustrated a prior art shelf system 100. Such shelf systems are available from Madix, Inc. and Lozier Corporation. The shelf system includes two strips of back railing or tracking 110 that includes a plurality of slots 112. The shelf system is illustrated as including six (6) shelves 120. Each shelf has a body 122 that has a top surface 124, a rear face 126, a front face 128 and first and second sides 130, 132. The rear face generally includes one or more hooks, brackets or other structures (not shown) that are designed to fit into one or more slots in back railing or tracking 110 to thereby secure the shelf to the back railing or tracking 110. The type of connection arrangement that exists on the rear face of the shelves and the manner in which the shelves are connected to back railing or tracking 110 are well known in the art and will not be further described herein. The front region of the top surface of the shelf typically includes a plurality of openings 140. As illustrated in FIG. 1, the shelves include two rows of openings; however, only one row or more than two rows of openings can exist on the top surface of the shelf. The width of the first and second sides 130, 132 of several of the shelves is illustrated as tapering in width from back to front; however, this is not required. For instance, as illustrated in FIG. 1, the width of the first and second sides 130, 132 of the bottom shelf is constant. The top surface of each shelf has a width W and a depth D. The width and/or depth of the top surface of two or more shelves can be the same or different. As illustrated in FIG. 1, the five shelves above the bottom shelf all have the same width and depth for the top surface. The bottom shelf has the same width as the other five shelves, but has a greater depth; however, this is not required.

Figure 5:
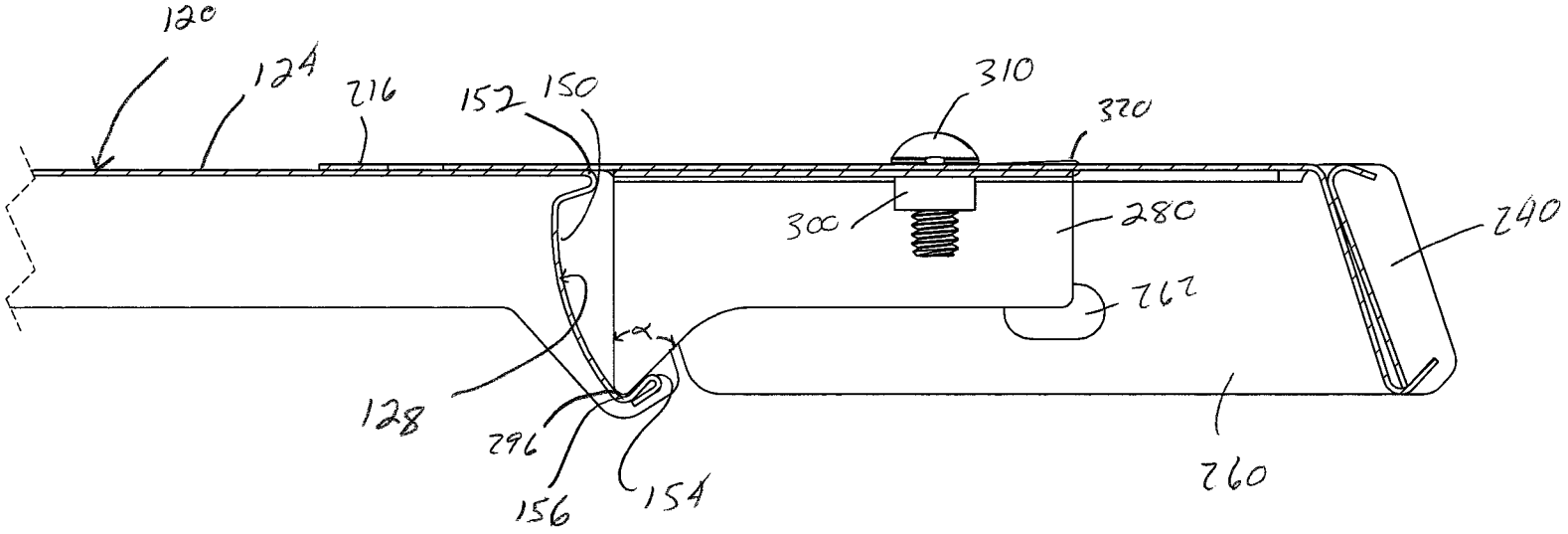
FIG. 5 is an enlarged cross-sectional view of the shelf extender connected to one of the shelves of the standard display shelf system of FIG. 1.
Figure 6:
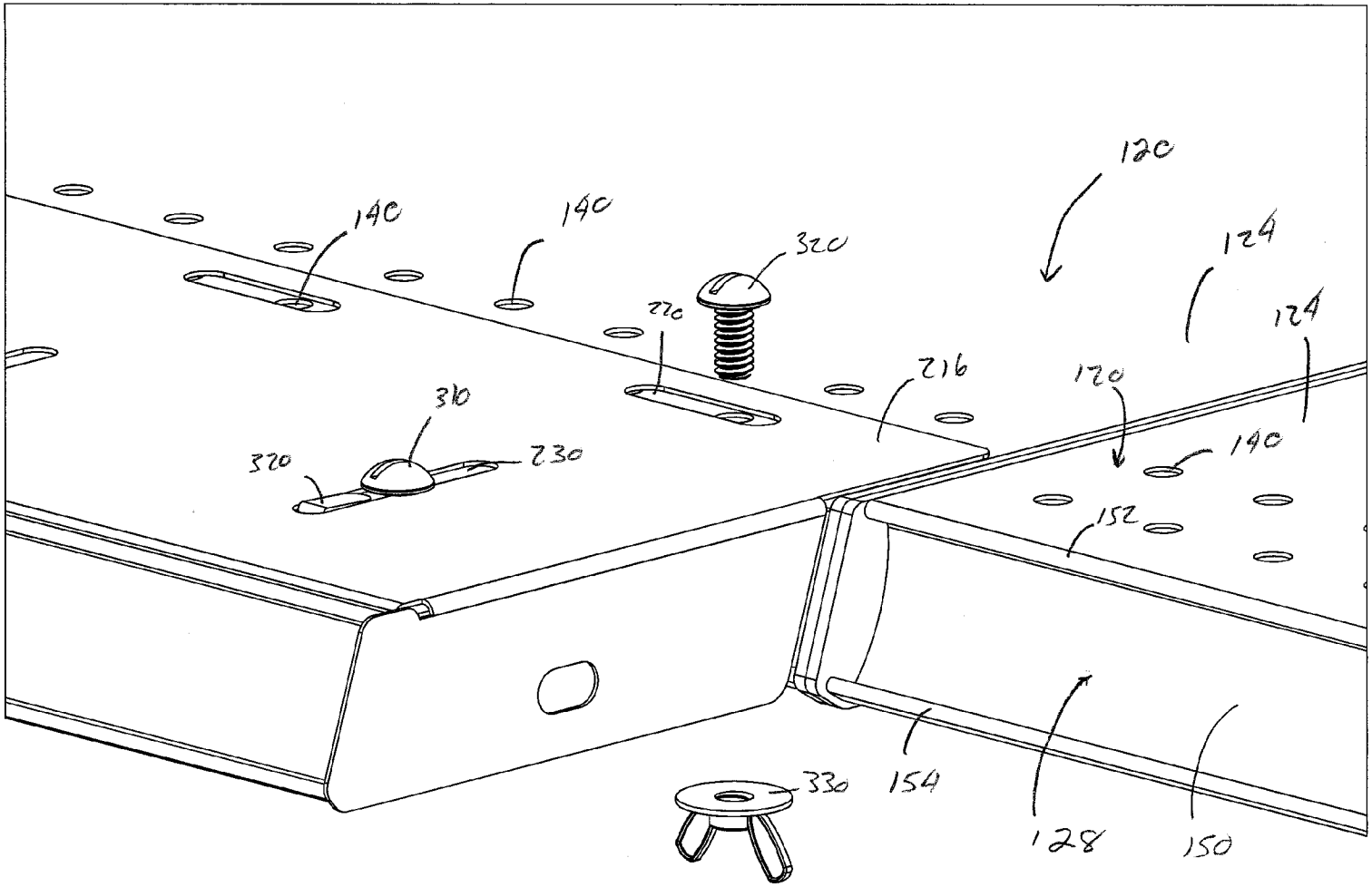
FIG. 6 is an enlarged side view of the shelf extender connected to one of the shelves of the standard display shelf system of FIG. 1.

As illustrated in FIGS. 5 and 6, the front face 128 of the shelves can include a concave or C-shaped cavity 150 that has an upper and lower lip 152, 154. The lower lip forms a base trough region 156 that can be used to facilitate in the connecting of the shelf extender to the shelf as will be described in more detail below. As can be appreciated, the front face of the shelves can have many other configurations.

Figure 2:
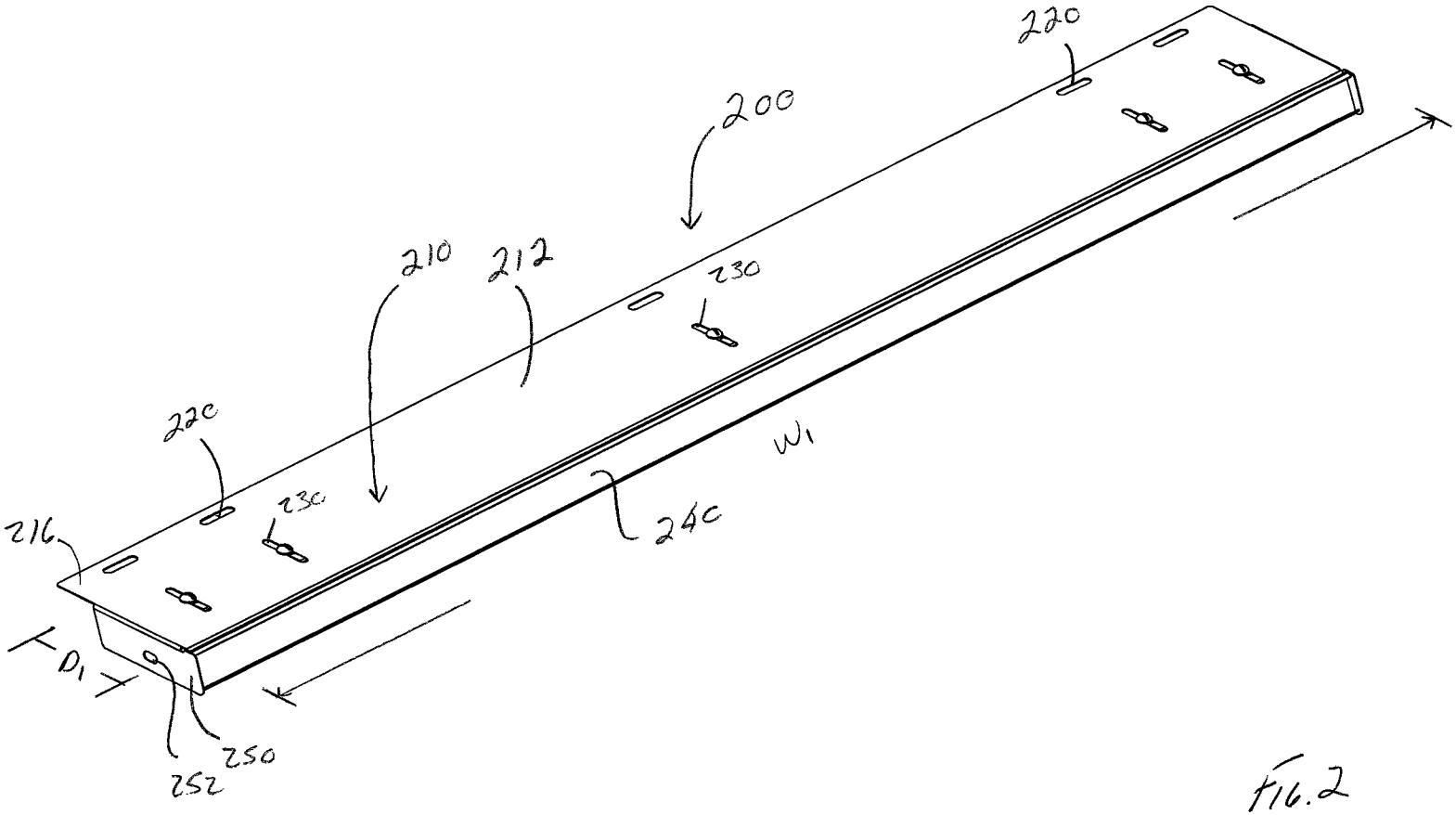
FIG. 2 is a front elevation view of one non-limiting shelf extender in accordance with the present invention.
Figure 3:
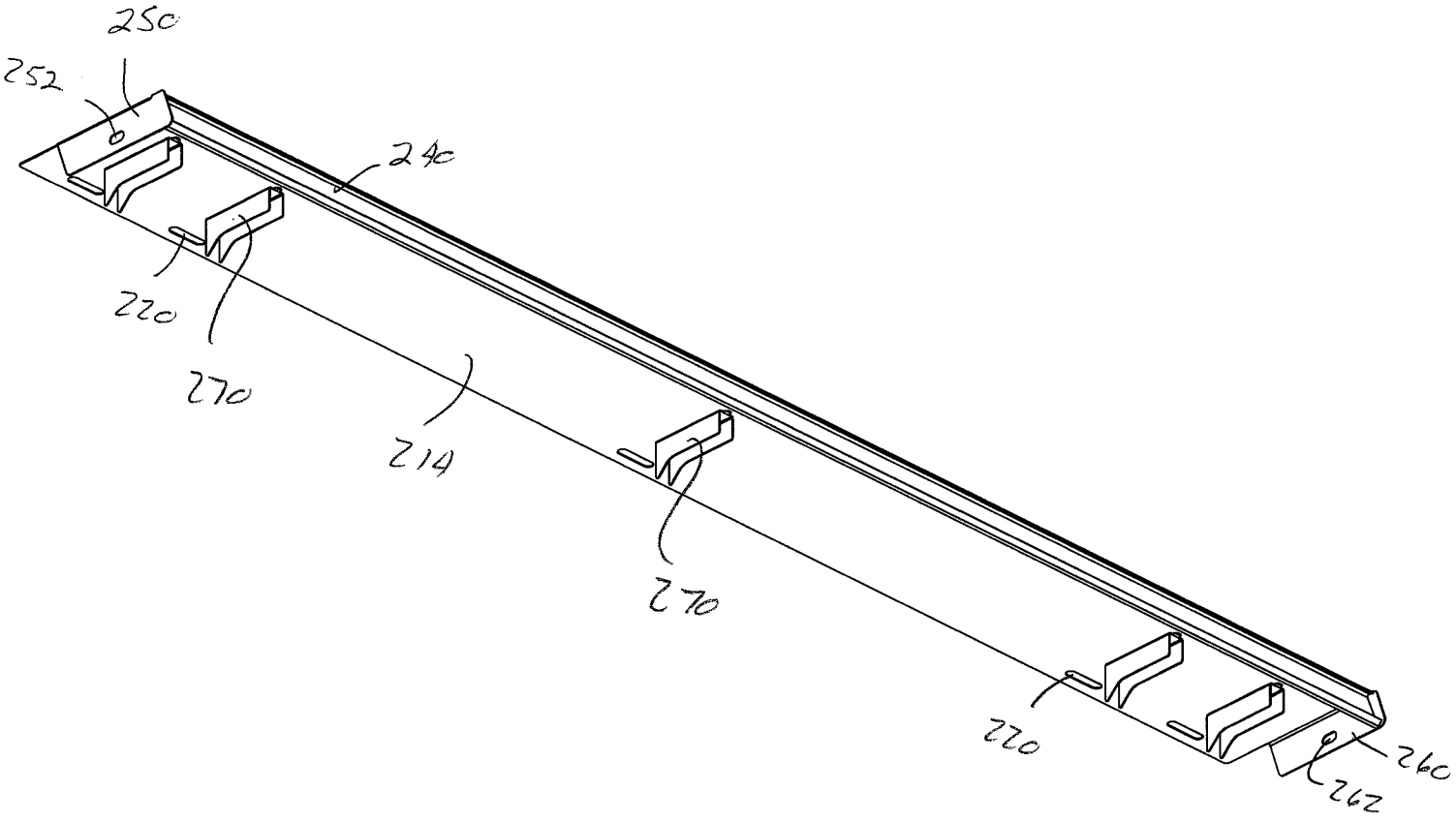
FIG. 3 is a bottom elevation view of the shelf extender of FIG. 2.

Referring now to FIGS. 2-7, there is illustrates one non-limiting configuration of a shelf extender 200 in accordance with the present invention. The shelf extender includes a body portion 210. The body portion has a top surface 212 that has a width W1 and depth D1. The top surface of the body portion also includes a plurality of intermediate openings 230 that are positioned at least partially forward of the rear openings. The number and position of the intermediate openings on the top surface is non-limiting. A connection arrangement in the form of a rear flange 216 extends rearwardly from the top surface of the body portion. The rear flange can be integrally formed with the top surface (e.g., both are formed of a single piece of material), or the rear flange can be connected to the body portion. The rear flange optionally includes a plurality of rear openings 220. As illustrated in FIG. 2, the rear openings and intermediate openings have an elongated slot shape; however, this is not required. When the rear openings have a elongated slot shape, the longitudinal axis of the rear opening is generally parallel with the longitudinal width of the shelf extender as illustrated in FIG. 2; however, this is not required. Such a configuration of the rear opening can be used to facilitate in positioning and aligning the rear openings with openings 140 in the shelf 120 when securing the shelf extender to the shelf; however, this is not required. When the intermediate openings have a elongated slot shape, the longitudinal axis of the rear opening is generally parallel with the longitudinal depth of the shelf as illustrated in FIG. 2; however, this is not required. Such a configuration of the intermediate openings can be used to facilitate in positioning and aligning the support flange relative to the bottom surface 214 of the body portion of the shelf extender; however, this is not required.

The body portion of the shelf extender can optionally include a front face 240 and one or more side flanges 250, 260. The side flanges can optionally include one or more openings 252, 262. The shape, size and configuration of the front face and/or side flanges (when used) are non-limiting. The side flanges (when used) are generally connected at or near the side edge of the body portion. The front face (when used) is generally connected at or near the front edge of the body portion.

Figure 4:
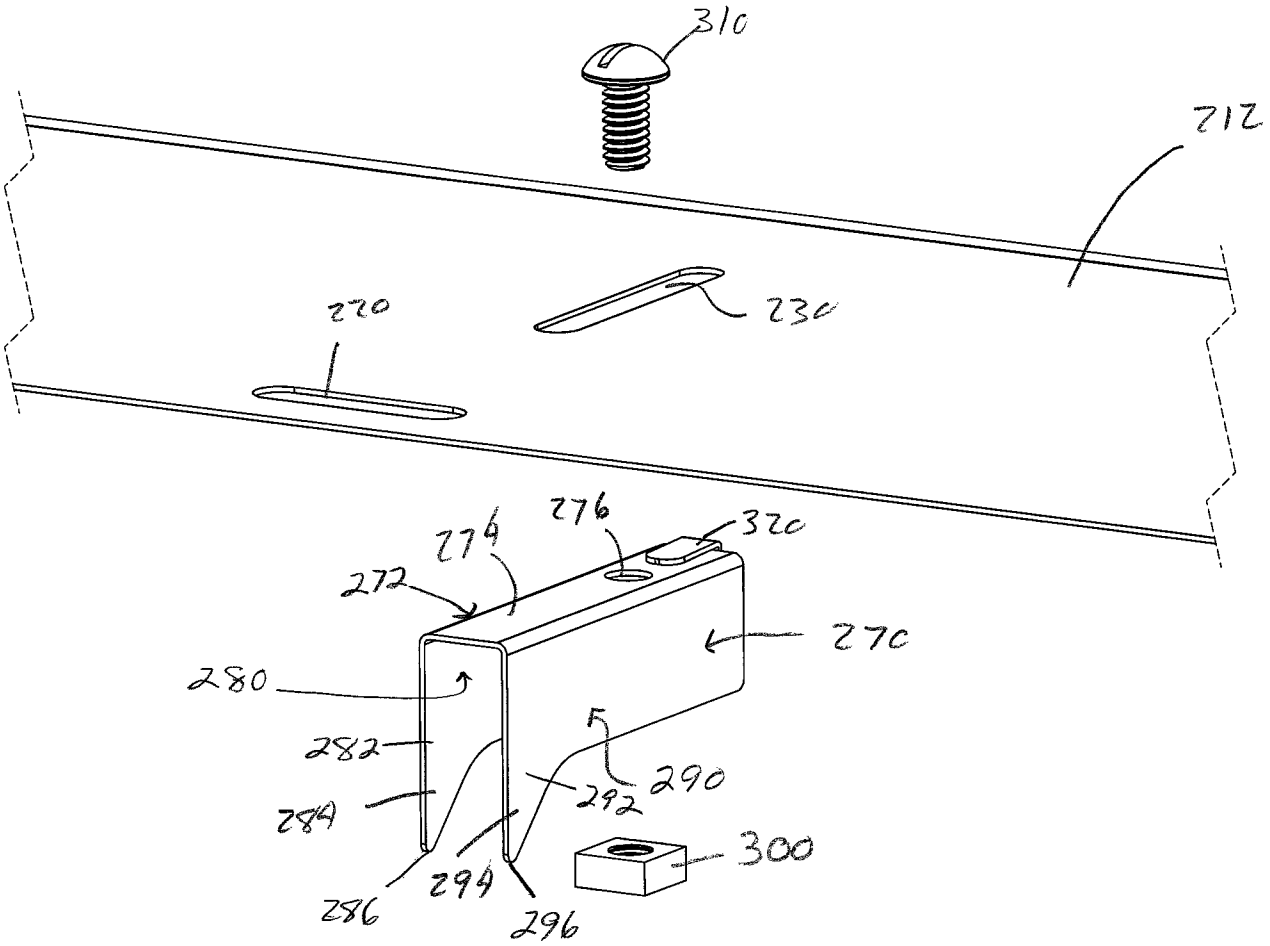
FIG. 4 is an enlarged exploded view of a portion of the shelf extender of FIG. 2.

One or more support flanges 270 can optionally be connected to the bottom surface 214 of the body portion. The one or more support flanges (when used) can be permanently connected or adjustably connected to the bottom surface 214 of the body portion. When the one or more support flanges are permanently connected to the bottom surface 214 of the body portion, such connection can be by weld, solder, adhesive, or some other non-adjustable arrangement. When the one or more support flanges are adjustably connected to the bottom surface 214 of the body portion, a bolt and nut, post and nut, or some other arrangement can be used. Referring now to FIG. 4, a bolt and nut arrangement for connecting the support flange 270 to the bottom surface 214 of the body portion is illustrated. The support flange 270 has a body 272 having a top surface 274. The top surface can include an opening, a threaded post, or some other type of arrangement used to connect the support flange to the body portion of the shelf extender. As illustrated in FIG. 4, the top surface includes a single opening 276; however, it can be appreciated that more than one opening can be included in the top surface. The body 272 optionally includes one or more flanges 280, 290. As illustrated in FIG. 4, the two flanges are positioned at each side of the body. The two flanges are spaced apart from one another so that a nut 300 can be positioned between the two flanges; however, this is not required. The rear portion 282, 292, of the flanges includes a downward extension 284, 294 that extends downwardly and narrows and forms a pointed or rounded tip 286, 296. As illustrated in FIG. 5, the pointed or rounded tips of the flanges are designed to sit in and rest in trough 156 of the front face of the shelf when the shelf extender is connected to the shelf. As illustrated in FIG. 5 the downward extension of the rear portion of the flanges enables the tip to rest in the tough. The rear edge of the rear portion is generally perpendicular (e.g., 90°, 80-120°) to the plane of the top surface of the flange, and the angle $\alpha$ between the rear edge and front edge of the rear portion is about 10-60° (e.g., 20-50°, 30-50°, 45). As illustrated in FIG. 5, the length of the support flange is generally less than the depth of the top surface of the body portion of the shelf extender; however, this is not required.

As illustrated in FIG. 4-5, the support flange is connected to the body portion of the shelf extender by a bolt 310 and nut 300. The threaded body of the bolt is inserted through opening 230, through opening 276 and threaded onto nut 300 thereby securing the support flange to the body portion. The support flange position relative to the body portion of the shelf extender can be adjusted by moving the bolt in the opening 230. As can be appreciated, opening 230 can be eliminated and a threaded post or other type of connector could extend from the bottom surface of the body portion for use in securing the support flange to the body portion. In such an arrangement, opening 276 could be slotted to allow for adjustment of the support flange relative to the body portion.

The front portion of the support flange can optionally include a positioning tab 320 that fits at least partially within opening 230 when the support flange is secured to the body portion. The positioning tab is used to prevent the support flange from twisting about bolt 310 once connected to the body portion.

Referring now to FIGS. 1, 5 and 6, when the shelf extender 200 is connected to a shelf 120, the rounded tips 286, 296 of the support flange are positioned in trough 156 of the front face of the shelf as illustrated in FIG. 5 and the rear flange 216 is then secured to the top surface of the shelf. As illustrated in FIG. 6, a threaded bolt 320 and nut 330 can be used to secure the rear flange to the shelf. The body of the threaded bolt is inserted through opening 220 and through opening 140 and thereafter the nut (e.g., wing nut, etc.) is threaded to the bolt to secure the rear flange to the shelf.

As illustrated in FIG. 1, the depth D1 of the top surface of the body of the shelf extender is typically less than the depth D of the shelf. As also illustrated in FIG. 1, the W1 of the shelf extender is generally the same as the width W of the shelf.

Figure 7:
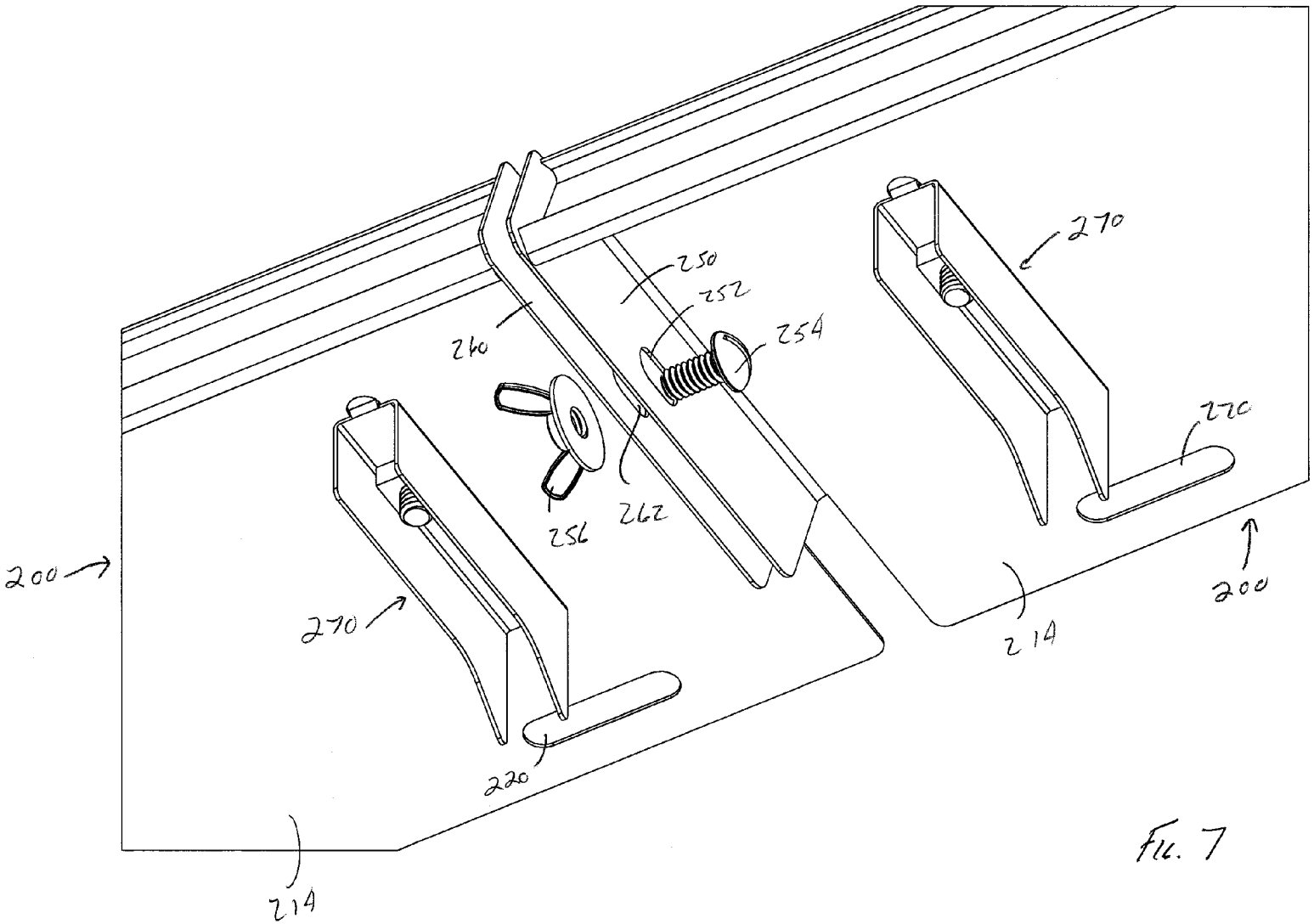
FIG. 7 is an enlarged bottom view of two adjacently positioned shelf extenders of FIG. 2.
Figure 8:
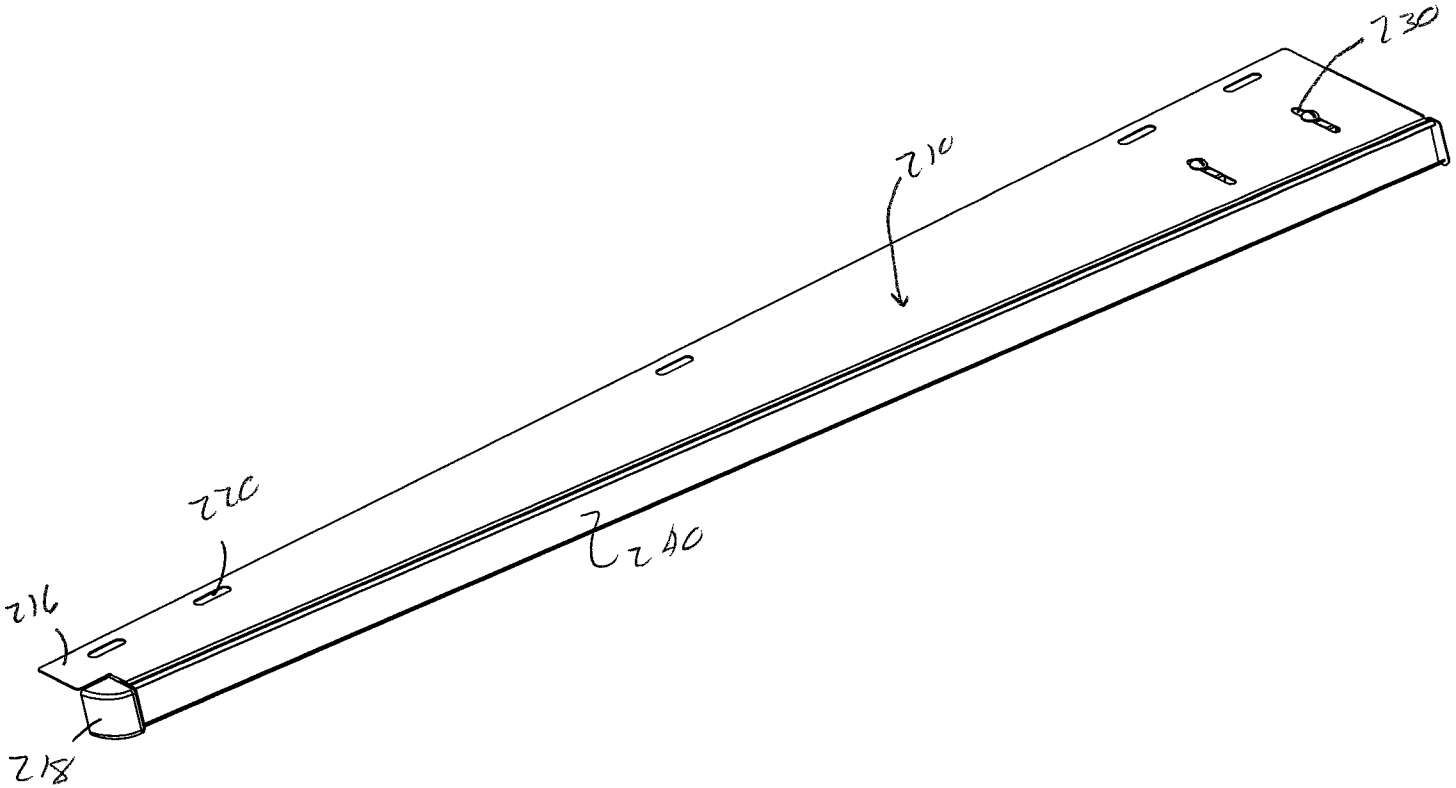
FIG. 8 is a front elevation view of another non-limiting shelf extender in accordance with the present invention.
Figure 9:
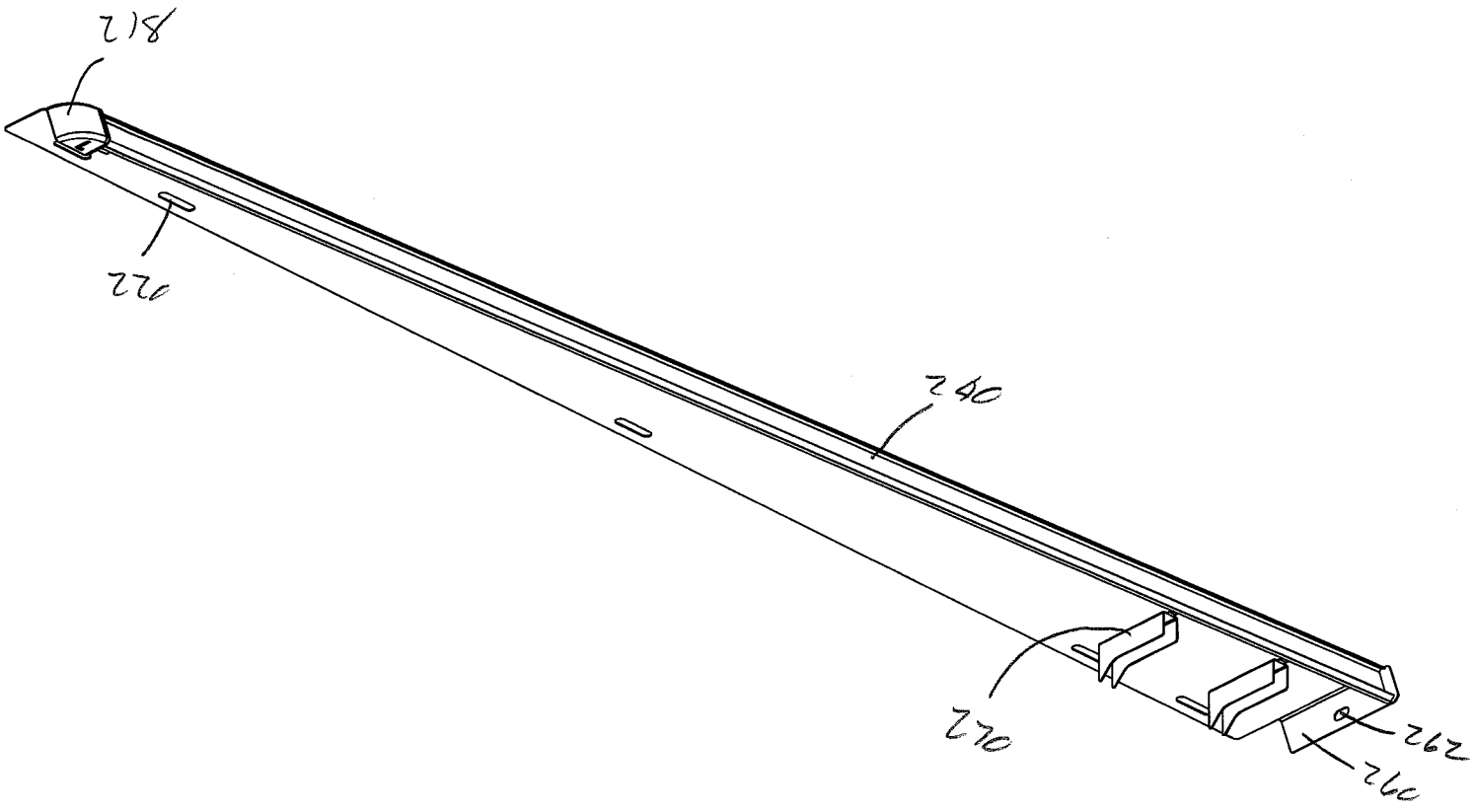
FIG. 9 is a bottom elevation view of the shelf extender of FIG. 8.
Figure 10:
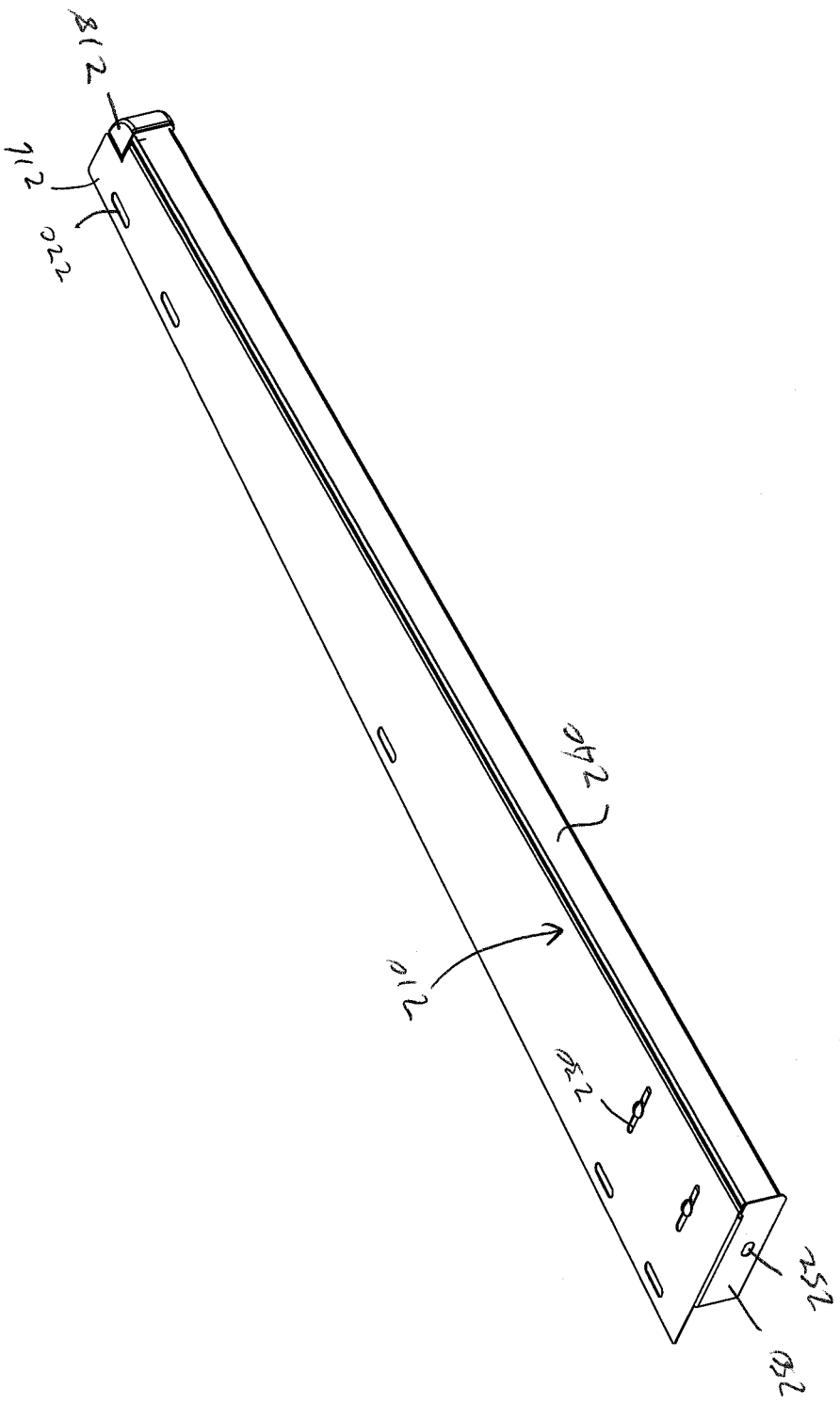
FIG. 10 is a front elevation view of another non-limiting shelf extender in accordance with the present invention.
Figure 11:
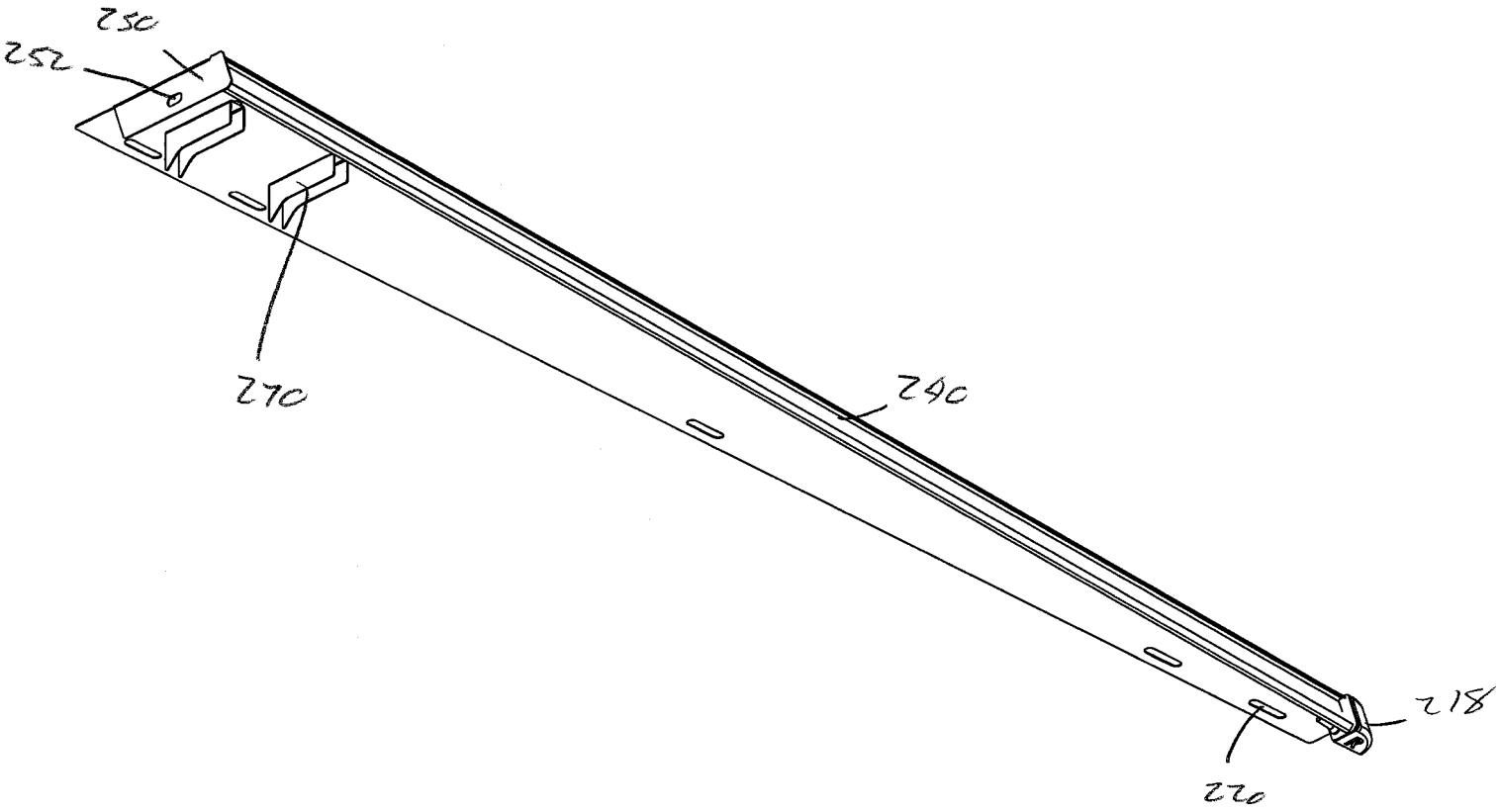
FIG. 11 is a bottom elevation view of the shelf extender of FIG. 10.

When two shelf extenders are positioned adjacent to one another, the shelf extenders can optionally be connected together. As illustrated in FIG. 7, a bolt 254 and nut arrangement 256 can be used. The threaded body of the bolt can be inserted through adjacently positioned openings 252, 262 of side flanges on two shelf extenders and the nut (e.g., wing nut, etc.) can then be threaded onto the bolt thereby securing together the two adjacently positioned shelf extenders.

Referring now to FIGS. 8-11, two alternative configurations of the shelf extender are illustrated. The basic features and components of the shelf extenders of FIGS. 8-11 are the same as the shelf extender illustrated in FIGS. 1-7 except that the top surface of the body portion of the shelf extend does not have a constant depth along the longitudinal length of the shelf extender. As such, similar numbering for the shelf extender of FIGS. 1-7 will be used for the shelf extender of FIGS. 8-11. The method in which the shelf extenders of FIGS. 8-11 are connected to the shelf 120 are the same as the shelf extender of FIGS. 1-7. The number and/or position of the support flanges used on the shelf extenders of FIGS. 8-11 may be the same, more, or less than the number of support flanges used on the shelf extenders of FIGS. 1-7. The taper depth of the top surface of the shelf extenders of FIGS. 8-11 can be used for connecting to shelves located at the end of the shelf system. For example, the shelf extenders of FIGS. 8-9 can be used on the left end of a shelf system and the shelf extenders of FIGS. 10-11, can be used on the right end of a shelf system; however, this is not required. The narrow ends of the shelf extender can include a rounded edge 218 to eliminate sharp edges; however, this is not required.

Figure 12:
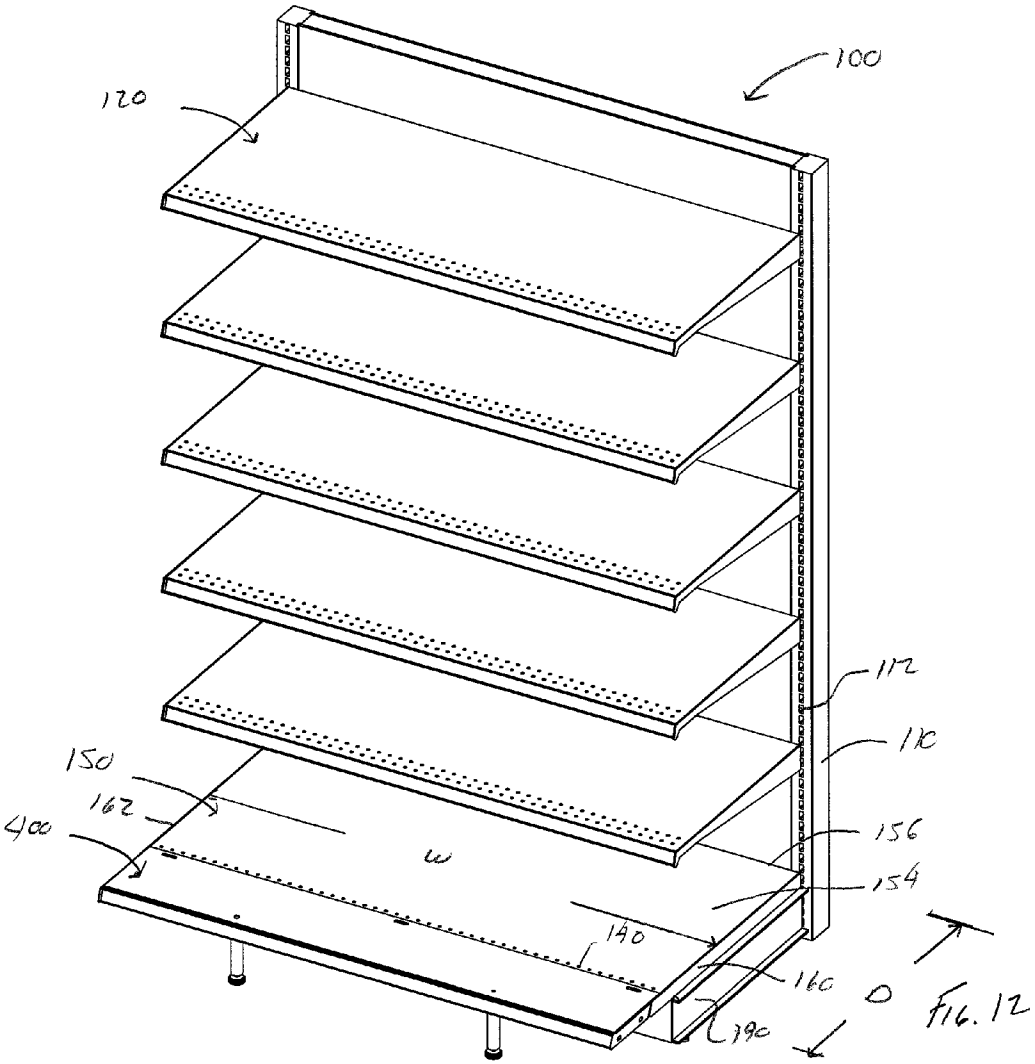
FIG. 12 is a front elevation view of a standard display shelf system wherein the base shelf includes a shelf extender in accordance with the present invention.

Referring now to FIG. 12, there is illustrated a prior art shelf system 100 that includes a shelf extender 400 connected to the base shelf 150. The base shelf has a body 152 that has a top surface 154, a rear face 156, a front face 158 and first and second sides 160, 162. The rear face generally includes one or more hooks, brackets or other structures (not shown) that are designed to fit into one or more slots on back railing or tracking 110 to thereby secure the shelf to the back railing or tracking 110. The type of connection arrangement that exists on the rear face of the base shelf and the manner in which the base shelf is connected to back railing or tracking 110 are well known in the art and will not be further described herein. The front region of the top surface of the base shelf typically includes a plurality of openings 140. As illustrated in FIG. 12, the base shelf include two rows of openings; however, only one row or more than two rows of openings can exist on the top surface of the shelf. The width of the first and second sides of the base shelf is illustrated as constant; however, this is not required. The top surface of the base shelf has a width W and a depth D.

Figure 16:
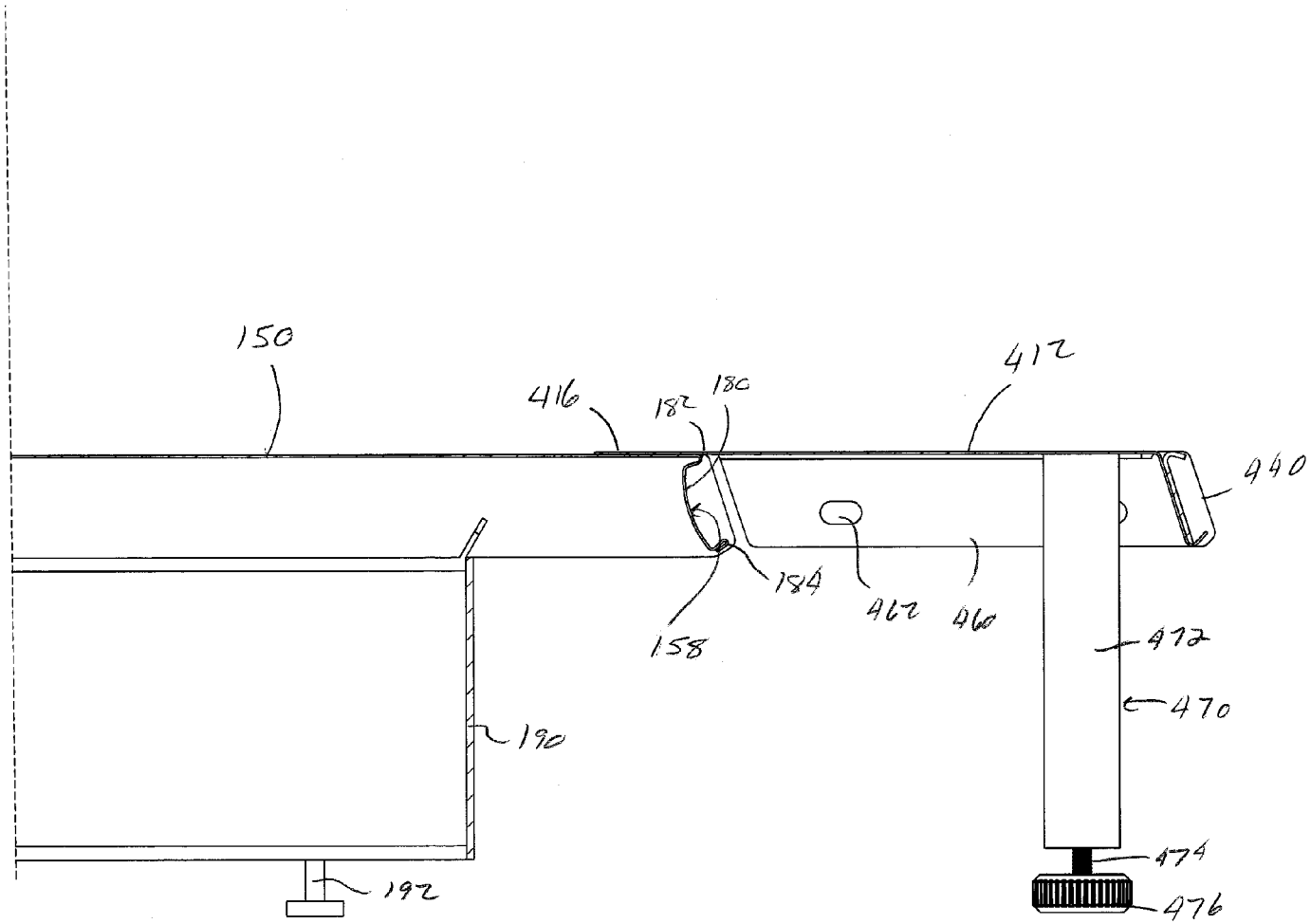
FIG. 16 is an enlarged cross-sectional view of the shelf extender connected to the base shelf of the standard display shelf system of FIG. 12.

As illustrated in FIG. 16, the front face 158 of the base shelf can optionally include a concave or C-shaped cavity 180 that has an upper and lower lip 182, 184. As can be appreciated, the front face of the shelves can have many other configurations. The base shelf is illustrated in FIGS. 12 and 16 as resting on the top of a bottom support structure 190 of the shelf system. The configuration of the bottom support structure is non-limiting. The bottom support structure can optionally include one or more legs 192.

Figure 13:
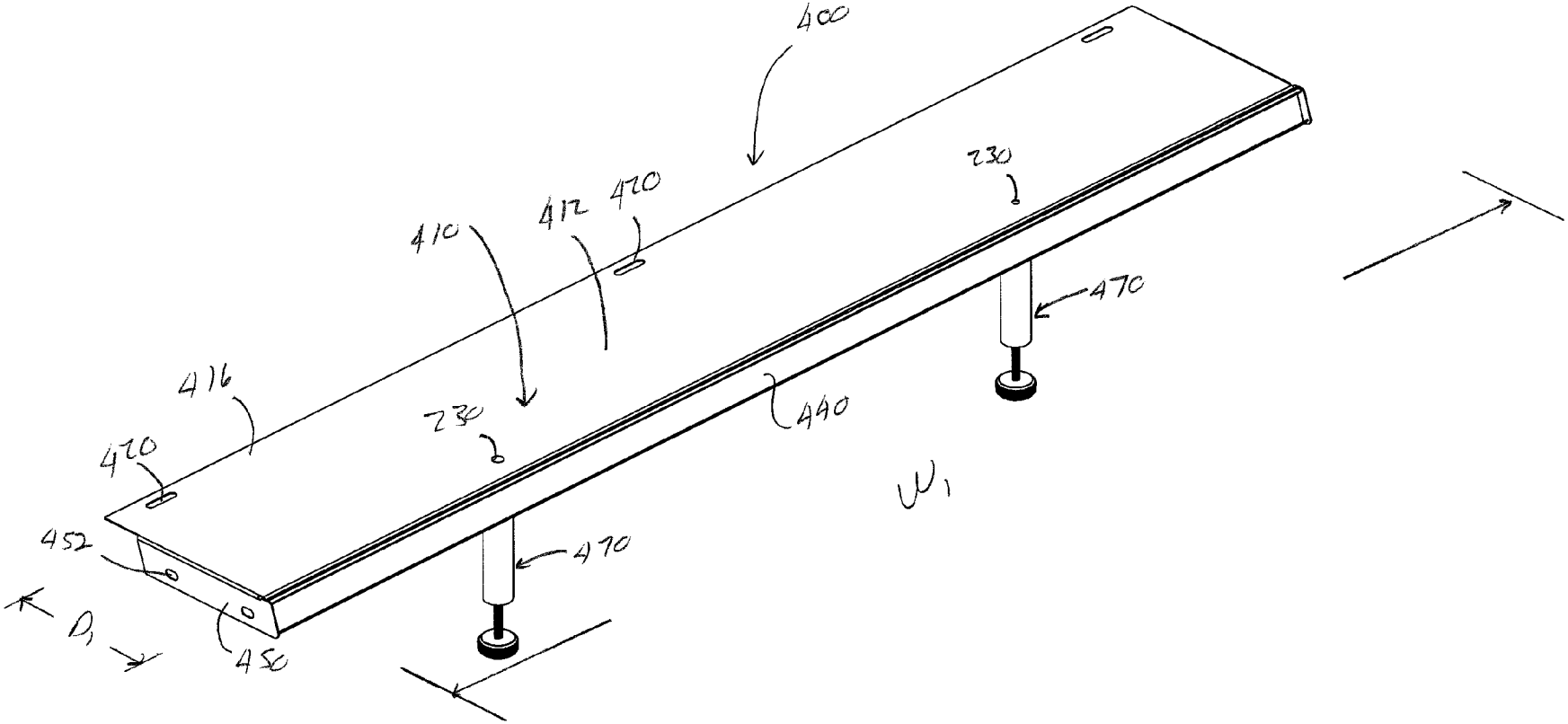
FIG. 13 is a front elevation view of another non-limiting shelf extender in accordance with the present invention.
Figure 14:
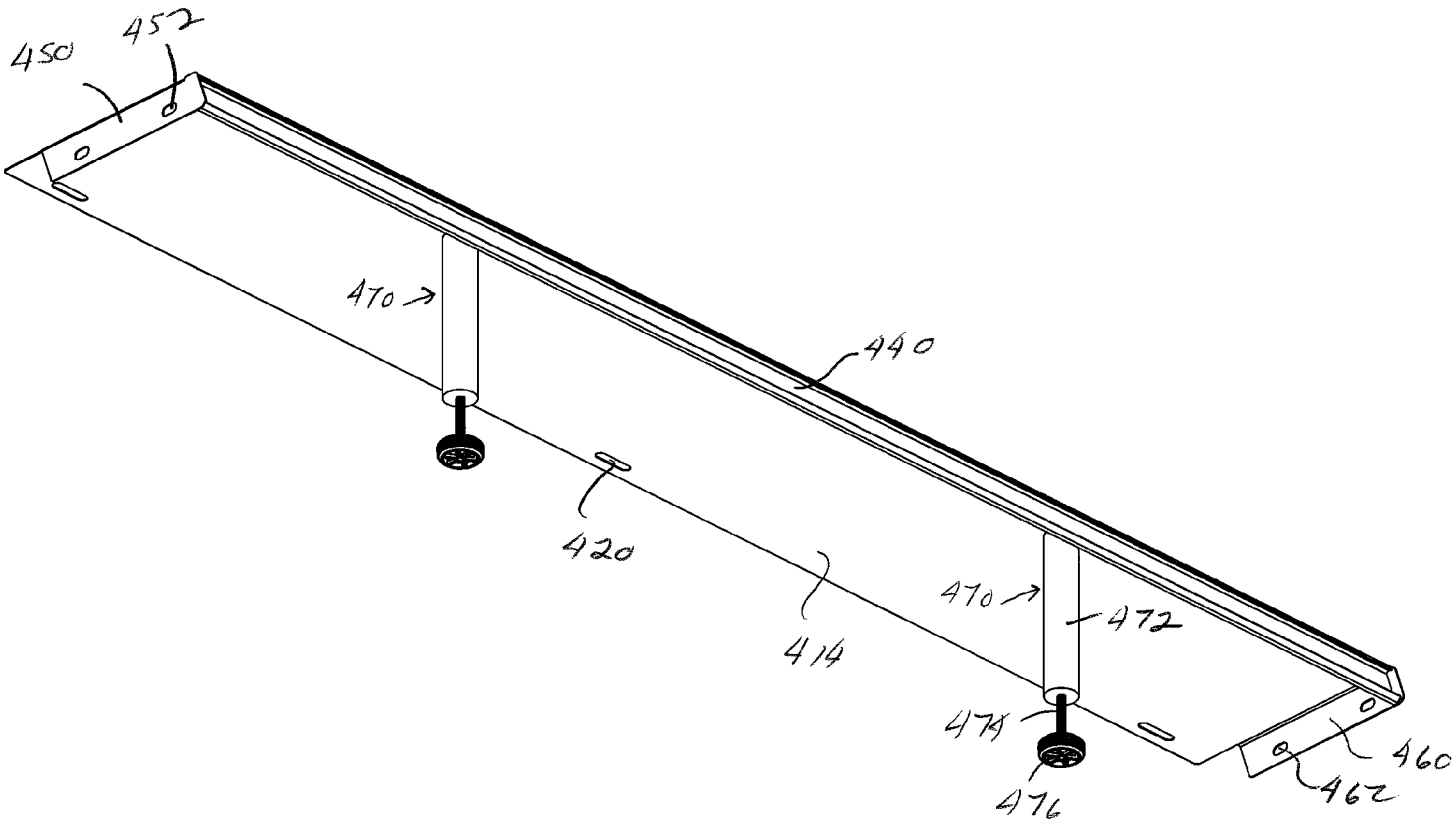
FIG. 14 is a bottom elevation view of the shelf extender of FIG. 13.

Referring now to FIGS. 13-18, there is illustrated one non-limiting configuration of a shelf extender 400 in accordance with the present invention. The shelf extender includes a body portion 410. The body portion has a top surface 412 that has a width W1 and depth D1. The top surface of the body portion also includes a plurality of intermediate openings that include permanent threaded studs 230; however, this is not required. The intermediate openings are positioned at least partially forward of the rear openings in the rear flange. The number and position of the intermediate openings and threaded studs are non-limiting. A connection arrangement in the form of a rear flange 416 extends rearwardly from the top surface of the body portion. The rear flange can be integrally formed with the top surface (e.g., both are formed of a single piece of material), or the rear flange can be connected to the body portion. The rear flange optionally includes a plurality of rear openings 220. As illustrated in FIG. 13, the rear openings have an elongated slot shape; however, this is not required. When the rear openings have an elongated slot shape, the longitudinal axis of the rear opening is generally parallel with the longitudinal width of the shelf extender as illustrated in FIG. 13; however, this is not required. Such a configuration of the rear openings can be used to facilitate in positioning and aligning the rear openings with openings 140 in the base shelf 150 when securing the shelf extender to the base shelf; however, this is not required. When the intermediate openings have an elongated slot shape; however, this is not required. As can be appreciated, the threaded stud 230 can be substituted for a bolt or other type of connector.

The body portion of the shelf extender can optionally include a front face 440 and one or more side flanges 450, 460. The side flanges can optionally include one or more openings 252, 262. The shape, size and configuration of the front face and/or side flanges (when used) are non-limiting. The side flanges (when used) are generally connected at or near the side edge of the body portion. The front face (when used) is generally connected at or near the front edge of the body portion.

Figure 15:
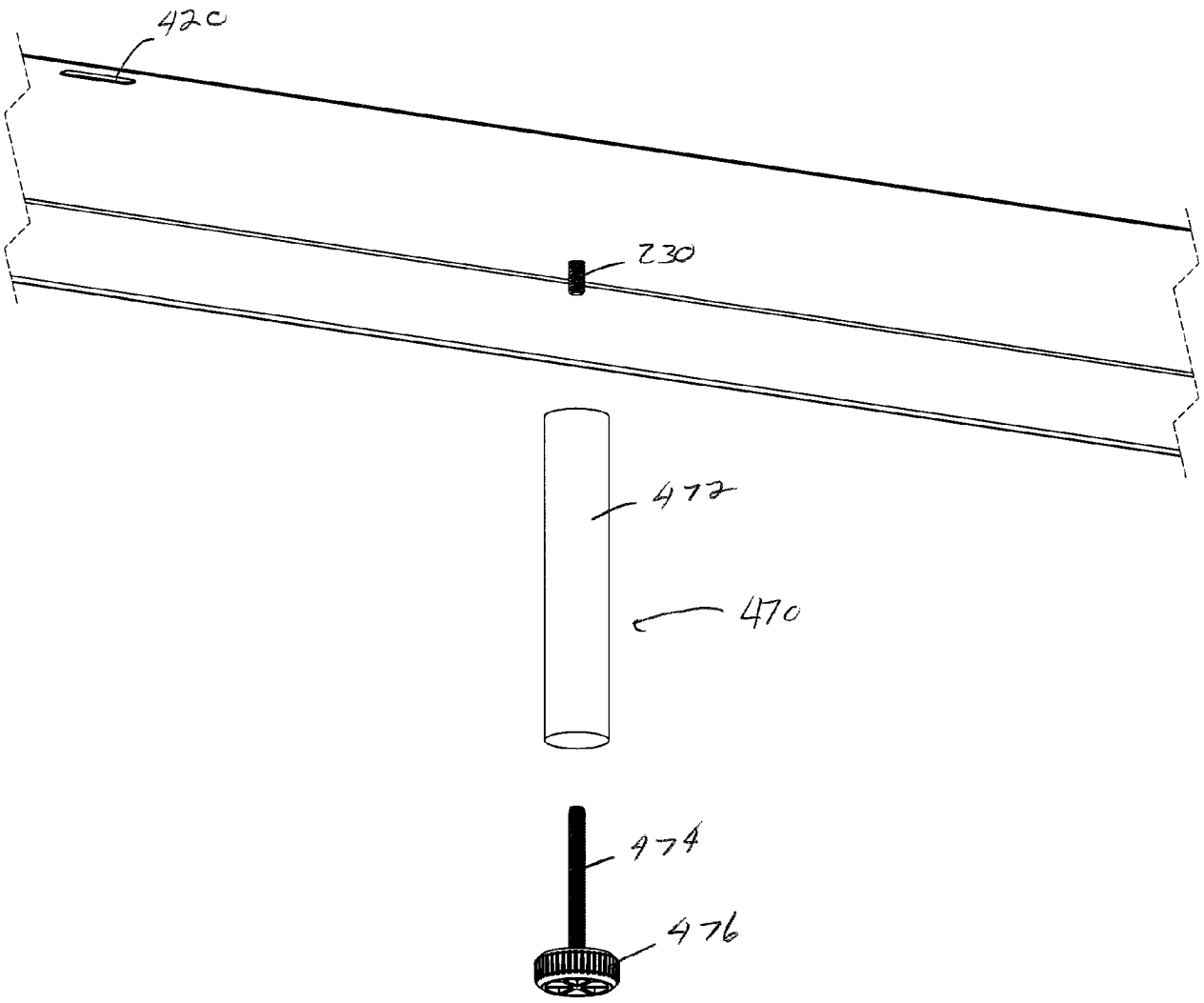
FIG. 15 is an enlarged exploded view of a portion of the shelf extender of FIG. 13.

One or more legs 470 can optionally be connected to the bottom surface 414 of the body portion. The one or more legs (when used) can be permanently connected or removably connected to the bottom surface of the body portion. When the one or more legs are permanently connected to the bottom surface 414 of the body portion, such connection can be by weld, solder, adhesive, or some other non-adjustable arrangement. When the one or more legs are adjustably connected to the bottom surface 414 of the body portion, a bolt and nut, post and nut, or some other arrangement can be used. Referring now to FIG. 15, a threaded stud 230 extends from the bottom surface of the body portion and is designed to connect to leg 470. Leg 470 includes a body 472 and a base 476 that includes a threaded post 474. The top of the body 472 includes an opening that is designed to threadedly receive threaded stud 230 so as to connect the body to the bottom surface of the body portion. The bottom surface of the body includes an opening that is designed to receive threaded post 474. The length of the leg can be adjusted by adjustably threading post 474 into the bottom opening of body 472. As can be appreciated, leg 470 is not required to be adjustable in length.

Figure 17:
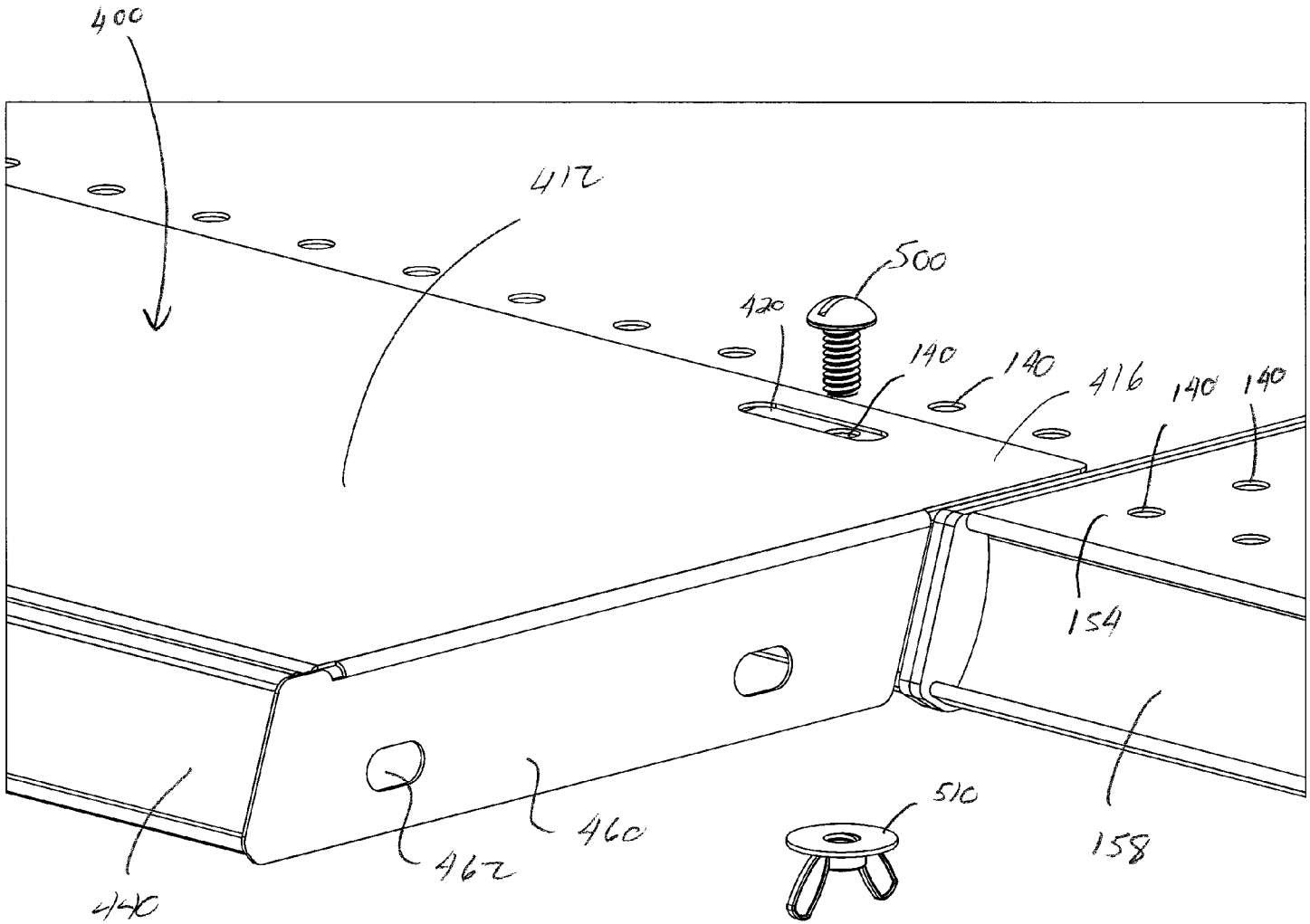
FIG. 17 is an enlarged side view of the shelf extender connected to the base shelf of the standard display shelf system of FIG. 12.

As illustrated in FIGS. 12, 16 and 17, the shelf extender 400 is connected to a base shelf 150 by positioning the rear of the body portion of the shelf extender on or closely adjacent to the front face 158 of the base shelf. Thereafter, a threaded bolt 500 and nut 510 can be used to secure the rear flange to the shelf. The body of the threaded bolt is inserted through opening 420 and through opening 140 and thereafter the nut (e.g., wing nut, etc.) is threaded to the bolt to secure the rear flange 416 to the base shelf 150. After the shelf extender is connected to the base shelf, the length of legs 470 can be adjusted to provide the desired support to the shelf extender.

As illustrated in FIG. 12, the depth D1 of the top surface of the body of the shelf extender is typically less than the depth D of the base shelf. As also illustrated in FIG. 12, the W1 of the shelf extender is generally the same as the width W of the base shelf.

Figure 18:
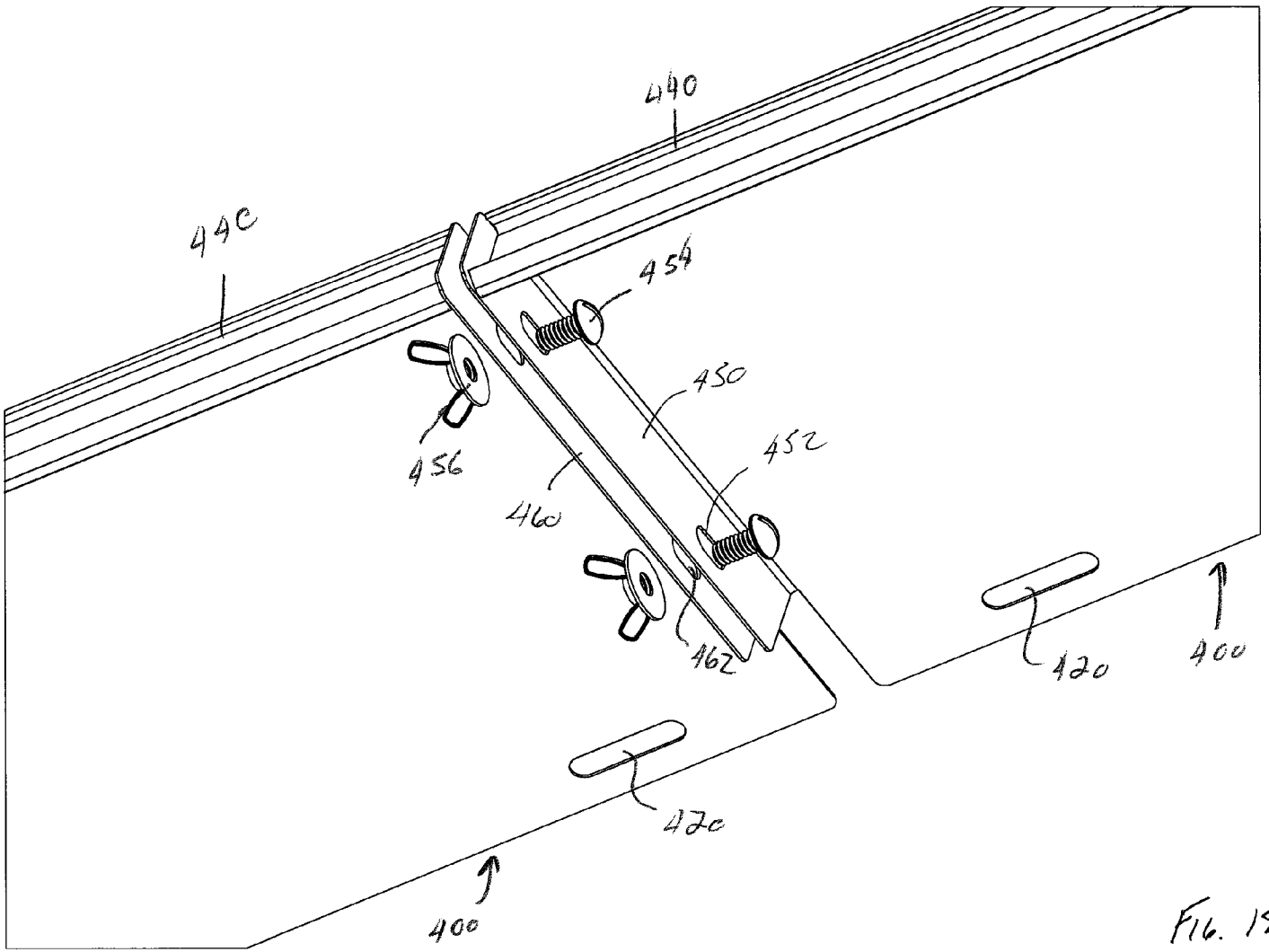
FIG. 18 is an enlarged bottom view of two adjacently positioned shelf extenders of FIG. 13.
Figure 19:
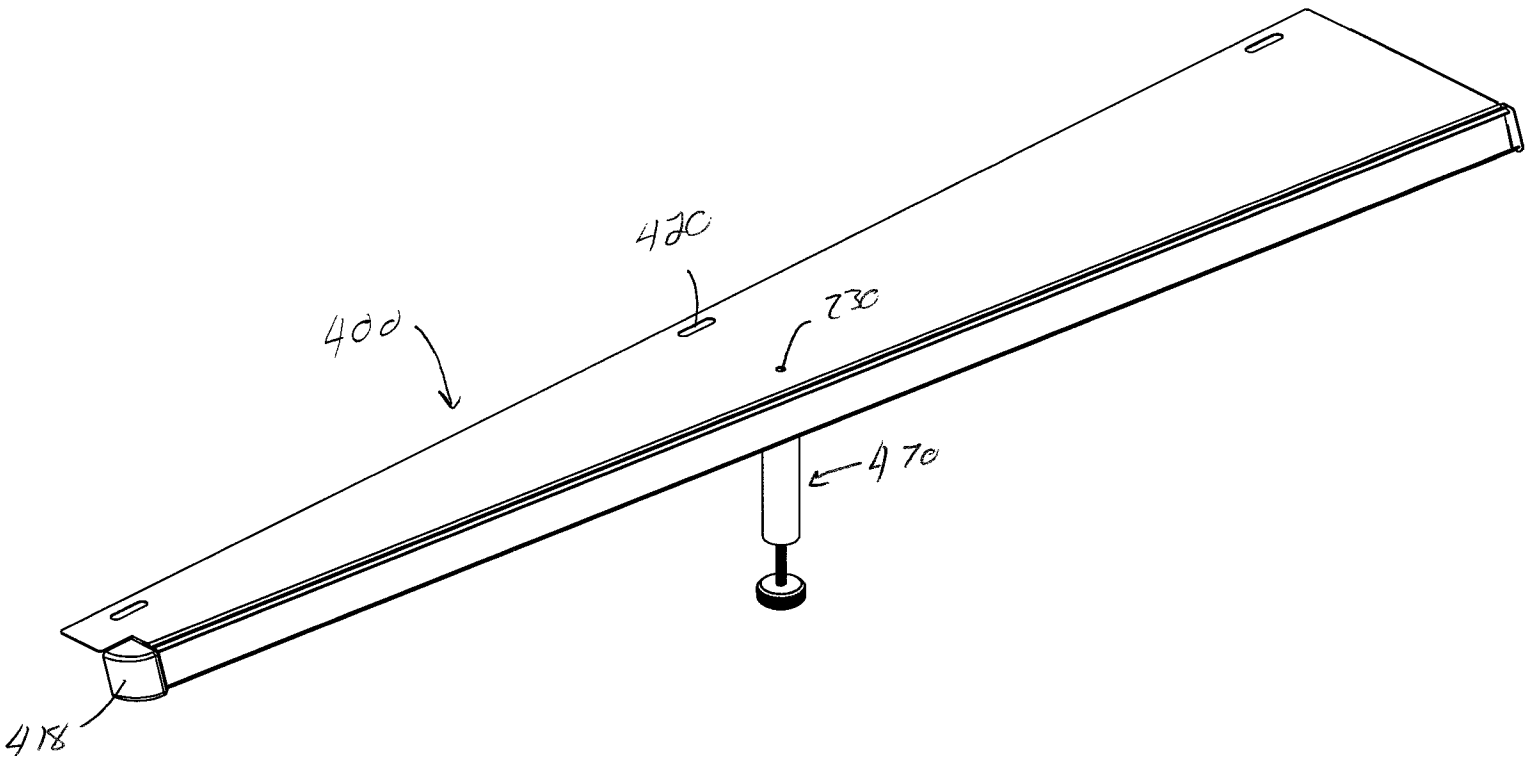
FIG. 19 is a front elevation view of another non-limiting shelf extender in accordance with the present invention.
Figure 20:
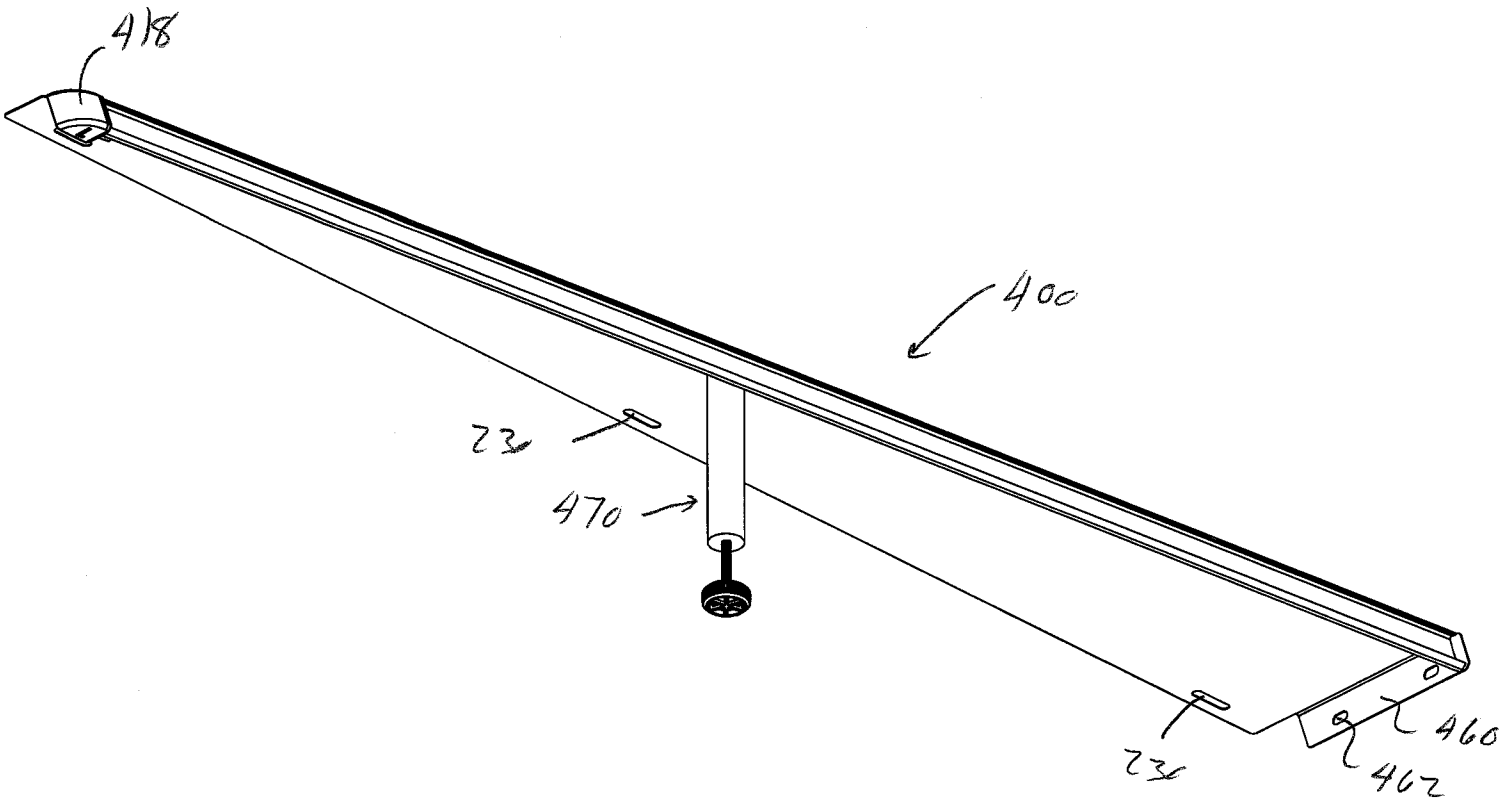
FIG. 20 is a bottom elevation view of the shelf extender of FIG. 19.
Figure 21:
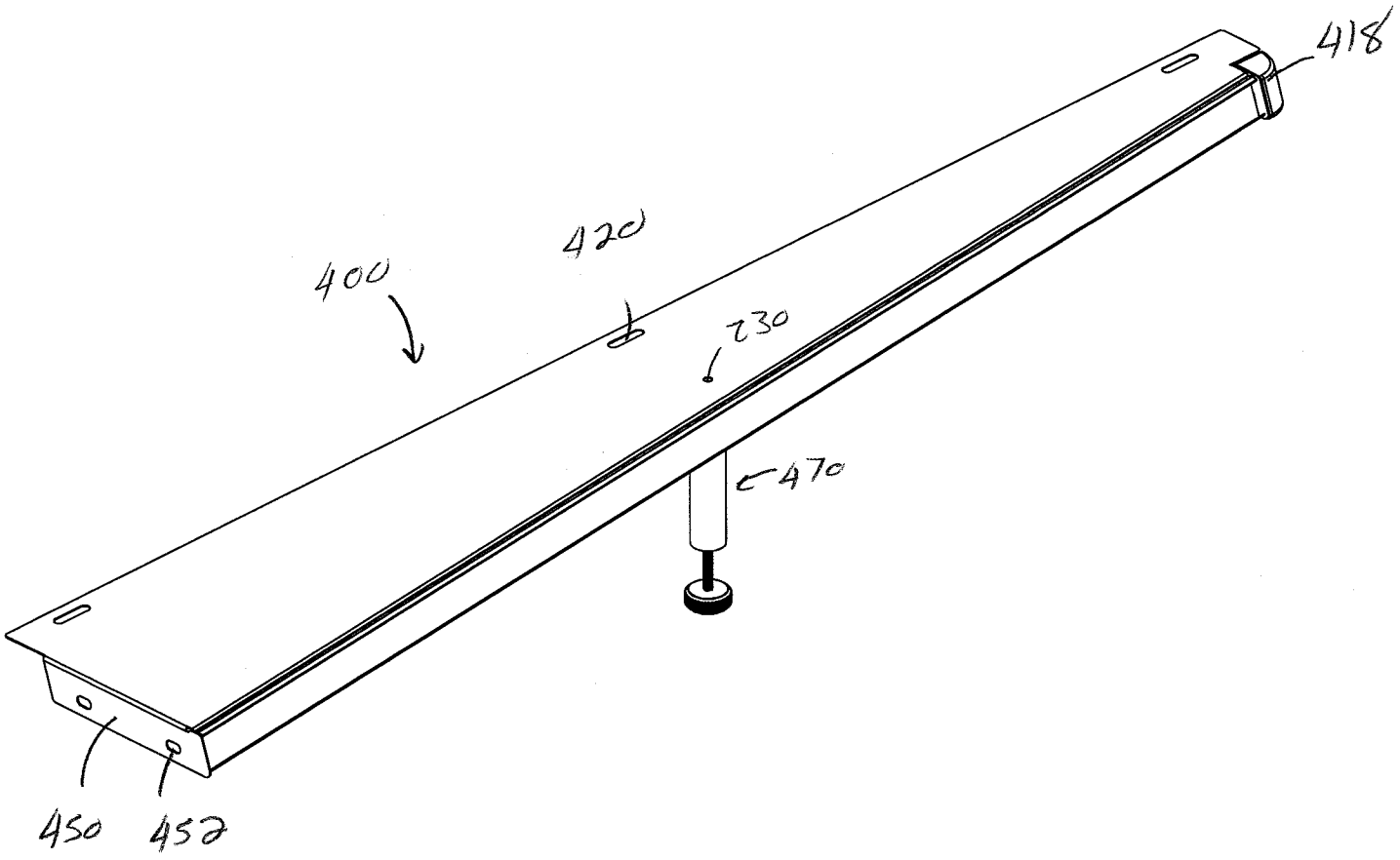
FIG. 21 is a front elevation view of another non-limiting shelf extender in accordance with the present invention; and, FIG. 22 is a bottom elevation view of the shelf extender of FIG. 21.
Figure 22:
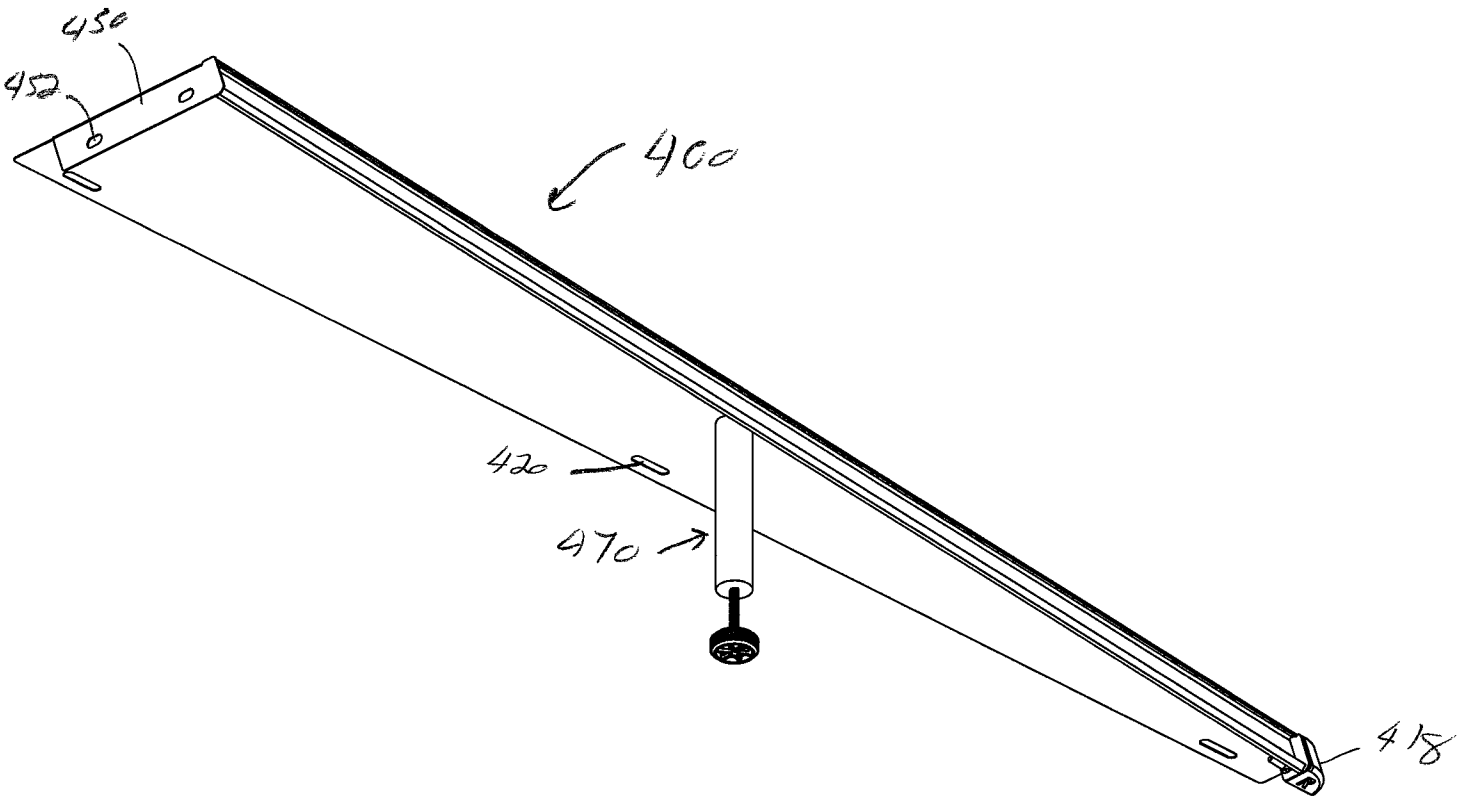

When two shelf extenders are positioned adjacent to one another, the shelf extenders can optionally be connected together. As illustrated in FIG. 18, a bolt 454 and nut arrangement 456 can be used. The threaded body of the bolt can be inserted through adjacently positioned openings 452, 462 of side flanges on two shelf extenders and the nut (e.g., wing nut, etc.) can then be threaded onto the bolt thereby securing together the two adjacently positioned shelf extenders.

Referring now to FIGS. 19-22, two alternative configurations of the shelf extender are illustrated. The basic features and components of the shelf extenders of FIGS. 19-22 are the same as the shelf extender illustrated in FIG. 12-18 except that the top surface of the body portion of the shelf extend does not have a constant depth along the longitudinal length of the shelf extender. As such, similar numbering for the shelf extender of FIGS. 12-18 will be used for the shelf extender of FIGS. 19-22. The method in which the shelf extenders of FIGS. 19-22 are connected to the base shelf 150 are the same as the shelf extender of FIGS. 12-18. The number and/or position of the legs 470 used on the shelf extenders of FIGS. 19-22 may be the same, more, or less than the number of support flanges used on the shelf extenders of FIGS. 12-18. The taper depth of the top surface of the shelf extenders of FIGS. 19-22 can be used for connecting to shelves located at the end of the shelf system. For example, the shelf extenders of FIGS. 19-20 can be used on the left end of a shelf system and the shelf extenders of FIGS. 21-22, can be used on the right end of a shelf system; however, this is not required. The narrow ends of the shelf extender can included a rounded edge 418 to eliminate sharp edges; however, this is not required.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween. The invention has been described with reference to the preferred embodiments. These and other modifications of the preferred embodiments as well as other embodiments of the invention will be obvious from the disclosure herein, whereby the foregoing descriptive matter is to be interpreted merely as illustrative of the invention and not as a limitation. It is intended to include all such modifications and alterations insofar as they come within the scope of the appended claims.

What is claimed:

1. A shelf extender that is designed to be connected to a shelf of an existing shelf system to increase a total depth of a shelf of the shelf system, said shelf extender comprising:

a body portion including a top and bottom surface, said top surface having a generally flat and planar surface, said top surface having a width and a depth, said depth of said top surface less than a depth of a top surface of the shelf, the body portion further comprising a front flange connected to a front edge of the top surface;

a connection arrangement lying in a same plane as said top surface of said body portion, said connection arrangement connected to said body portion, said connection arrangement including a connector designed to secure said connection arrangement to a top surface of the existing shelf; and a support flange connected to the bottom surface of the body portion and comprising a rear portion that comprises a downward extension that narrows to form a pointed or rounded tip that is a vertex of a rear edge and a front edge of the downward extension of the support flange, the rear edge positioned at an angle between 80 and 120 degrees relative to the plane of the top surface of the body portion, and the front edge of the rear portion is positioned at an angle between 10 and 60 degrees relative to the rear edge of the rear portion, the front edge of the downward extension is positioned between the front flange of the body portion and the rear edge of the support flange.

2. The shelf extender as defined in claim 1, wherein said connection arrangement is integrally formed with the top surface of said body portion and extends rearwardly of said top surface.

3. The shelf extender as defined in claim 1, wherein said connection arrangement includes a plurality of openings designed to align with openings in the top surface of the shelf of the existing shelf system.

4. The shelf extender as defined in claim 1, wherein said body portion includes a side flange that connects to a side edge of said top surface, said side flange including a connector system designed to connect said side flange to a side flange of an adjacently positioned shelf extender.

5. The shelf extender as defined in claim 1, including a leg connectable to the bottom surface of said body portion.

6. The shelf extender as defined in claim 5, wherein a longitudinal axis of said leg is perpendicular to a plane of said bottom surface of said body portion.

7. The shelf extender as defined in claim 5, wherein a length of said leg is adjustable.

8. The shelf extender as defined in claim 5, wherein said leg is threadedly connected to said bottom surface of said body portion.

9. The shelf extender as defined in claim 1, wherein a depth of the top surface of said body portion is variable along a longitudinal length of said top surface.

10. The shelf extender as defined in claim 1, wherein the rear portion of said support flange is designed to engage a front concave face of the shelf of the existing shelf system and be supported in the concave face when said shelf extender is connected to the shelf of the existing shelf system.

11. The shelf extender as defined in claim 1, wherein a length of said support flange is less than said depth of said top surface of said body portion.

12. The shelf extender as defined in claim 10, wherein said top surface of said body portion includes an opening for use in connecting said support flange to said body portion.

13. A shelf system comprising:

a shelf having a top surface, a rear portion and a front face, said rear portion connected to a support system of said shelf system, said top surface including a plurality of openings, said top surface having a width and a depth, the shelf comprises a lower lip that extends from a bottom of the front face of the shelf in a direction that is upward and forward such that the lower lip forms a trough that faces away from the support system; and a shelf extender connected to the shelf and including a body portion and a connection arrangement, said body portion including a top surface and a bottom surface, said top surface having a generally flat and planar surface, said top surface having a width and a depth, said depth of said top surface less than said depth of said top surface of said shelf, said connection arrangement lying in a same plane as said top surface of said body portion, said connection arrangement connected to said body portion, said connection arrangement including a connector designed to secure said connection arrangement to at least one of said openings in said top surface of said shelf, top surface of said shelf extender lying in a same plane or parallel plane to a plane of said top surface of said shelf, the shelf extender further comprising a support flange connected to the bottom surface of the body portion, and a rear portion of the support flange comprises a downward extension that narrows to form a pointed or rounded tip configured to rest in and be supported by the trough when the shelf extender is connected to the shelf, wherein the pointed or rounded tip of the rear portion of the support flange is a vertex of a rear edge and a front edge of the downward extension of the support flange, the rear edge positioned at an angle between 80 and 120 degrees relative to the plane of the top surface of the body portion, and the front edge of the rear portion is positioned at an angle between 10 and 60 degrees relative to the rear edge of the rear portion.

14. The shelf system as defined in claim 13, wherein said connection arrangement is integrally formed with a top surface of said body portion and extends rearwardly of said top surface, said connector of said connection arrangement including an opening designed to align with said opening in said top surface of said shelf when said shelf extender is connected to said shelf.

15. The shelf system as defined in claim 13, wherein said body portion of said shelf extender includes a side flange that connects to a side edge of said top surface, said side flange including a connector system designed to connect said side flange to a side flange of an adjacently positioned shelf extender.

16. The shelf system as defined in claim 13, wherein said shelf extender includes a leg, said leg connectable to a bottom surface of said body portion.

17. The shelf system as defined in claim 16, wherein a length of said leg is adjustable.

18. The shelf system as defined in claim 13, wherein a depth of the top surface of said body portion of said shelf extender is variable along a longitudinal length of said top surface.

* * * * *